US007492669B2

(12) United States Patent
Watanabe

(10) Patent No.: US 7,492,669 B2
(45) Date of Patent: Feb. 17, 2009

(54) TIMEPIECE ATTACHED WITH CALENDAR MECHANISM HAVING FIRST DATE INDICATOR AND SECOND DATE INDICATOR

(75) Inventor: Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/705,700

(22) Filed: Feb. 13, 2007

(65) Prior Publication Data

US 2007/0201312 A1 Aug. 30, 2007

(30) Foreign Application Priority Data

Feb. 20, 2006 (JP) ..... 2006-042595

(51) Int. Cl.
*G04B 19/24* (2006.01)

(52) U.S. Cl. ..... 368/28; 368/35

(58) Field of Classification Search ..... 368/28, 368/35

See application file for complete search history.

(56) References Cited

U.S. PATENT DOCUMENTS 2,976,672 A * 3/1961 Ducommun ..... 368/37
4,257,113 A * 3/1981 Meister et al. ..... 368/35
6,081,483 A * 6/2000 Capt et al. ..... 368/28
6,735,151 B2 * 5/2004 Triponez ..... 368/28
7,023,762 B1 * 4/2006 Burkhardt et al. ..... 368/35
7,180,829 B2 * 2/2007 Watanabe ..... 368/37
7,254,094 B2 * 8/2007 Watanabe ..... 368/37

* cited by examiner

*Primary Examiner*—Edwin A. Leon
*Assistant Examiner*—Thanh S Phan
(74) *Attorney, Agent, or Firm*—Adams & Wilks

(57) ABSTRACT

A timepiece is provided with a calendar mechanism having a first date indicator for indicating a units position of a date and a second date indicator for indicating a tens position of the date. The first date indicator has a drive cam for rotating the second date indicator and determining a position of the second date indicator. The second date indicator includes a first date character indicating face having numerals "1", "2", "3", and "0", and a second date character indicating face having a fan-like shape and including four pieces of trapezoidal-shaped portions formed by a pitch interval of (2*360/31) degrees through (3*360/31) degrees, three pieces of notched portions formed by a pitch interval of (2*360/31) degrees through (3*360/31) degrees, and a set of numerals comprising a numeral of "1", a numeral of "2", a numeral of "3", and a numeral of "0".

20 Claims, 17 Drawing Sheets

TIMEPIECE ATTACHED WITH CALENDAR MECHANISM HAVING FIRST DATE INDICATOR AND SECOND DATE INDICATOR

BACKGROUND OF THE INVENTION

1. Field of the Invention

The present invention relates to a timepiece attached with a calendar mechanism having a first date indicator for indicating a position of 1 of a date (i.e. units position of the date) and a second date indicator for indicating a position of 10 of a date (i.e. tens position of the date).

2. Description of the Prior Art

Generally, a machine body including a portion of driving a timepiece is referred to as "movement". A state of attaching a dial, hands to a movement to be put into a timepiece case to constitute a finished product is referred to as "complete" of a timepiece. In both sides of a main plate constituting a base plate of a timepiece, a side on which glass of a timepiece case is present, that is, a side on which a dial is present is referred to as "back side" or "glass side" or "dial side" of a movement. In both sides of a main plate, a side on which a case back of a timepiece case is present, that is, a side opposed to a dial is referred to as "top side" or "case back side" of a movement. A train wheel integrated to "top side" of a movement is referred to as "top train wheel". A train wheel integrated to "back side" of a movement is referred to as "back train wheel".

A timepiece attached with a calendar mechanism of a first type of a background art includes a dial having a large window, a rotating member for a position of 1 (that is, first date indicator) arranged with 31 pieces of numerals including one numeral of "1", numerals of 3 sets of "1" through "9" and "0", and provided with 4 pieces of teeth, further, includes a star shape plate for a position of 10 having 4 pieces of teeth, a rotating member for a position of 10 (that is, second date indicator) arranged with numerals of "0", "1", "2", "3". The rotating member for the position of 1 (that is, first date indicator) directly rotates the rotating member for the position of 10 (that is, second date indicator) (refer to, for example, Japanese Patent Publication No. 3390021).

A timepiece attached with a calendar mechanism of a second type of a background art includes a first date indicator for indicating a position of 1 of a dates a second date indicator for indicating a position of 10 of a date. The first date indicator is formed in a circular disk shape, a surface thereof is arranged with 10 pieces of numerals of "0" through "9". The second date indicator is formed in a fan shape, a surface thereof is arranged with 4 pieces of "0", "1", "2", "3" (refer to, for example, European Patent Application Publication No. EP1220059A1).

A timepiece attached with a calendar mechanism of a third type of a background art includes a first date indicator for indicating a position of 1 of a date, a second date indicator for indicating a position of 10 of a date. The first date indicator is formed in a circular disk shape, a surface thereof is arranged with 10 pieces of numerals of "0" through "9". The first date indicator is operated in a fan shape such that date characters are present within a range of a specific angle. The second date indicator is formed in a circular disk shape, a surface thereof is arranged with 4 pieces of "0", "1", "2", "3" (refer to, for example, Switzerland Patent Publication No. CH690515A5).

A timepiece attached with a calendar mechanism of a fourth type of a background art includes a first date indicator for indicating a position of 1 of a date, a second date indicator for indicating a position of 10 of a date. The first date indicator is formed in a circular disk shape, a surface thereof is arranged with 3 sets of 10 pieces of numerals of "0" through "9", further, arranged with 1 piece of a numeral of "1" to thereby arrange a total of 31 pieces of numerals. The second date indicator is formed in a circular disk shape, a surface thereof is arranged with 3 sets of 4 pieces of numerals of "0", "1", "2", "3" to thereby arrange a total of 12 pieces of numerals (refer to, for example, JP-A-2005-214837).

According to the timepiece attached with the calendar mechanism of the first type of the background art, a date indicating position is determined by the position of the rotating member for the position of 10 (that is, second date indicator) which poses a problem in that a design variation cannot be developed. Further, the rotating member for the position of 10 is rotated by 90 degrees by rotating the rotating member for the position of 1 (360°/31=11.6 degrees) and therefore, another problem is that operation of the rotating member for the position of 10 becomes unstable.

According to the timepiece attached with the calendar mechanism of the second type of the background art, a date indicating position is determined by the position of the first date indicator for indicating the position of 1 of the date which poses a problem in that a design variation cannot be developed. Further, another problem is that a date feeding mechanism becomes complicated.

According to the timepiece attached with the calendar mechanism of the third type of the background art, the position of the second date indicator for indicating the position of 10 of the date is disposed on an inner side of the position of the first date indicator for indicating the position of 1 of the date and therefore, a date indicating position cannot be arranged at a vicinity of an outer periphery of a timepiece resulting in a problem that a design variation is restricted. Further, another problem is that the date feeding mechanism becomes complicated.

According to the timepiece attached with the calendar mechanism of the fourth type of the background art, the second date indicator is formed in the circular disk shape, and an outer peripheral portion of the second date indicator overlaps the first date indicator, and therefore, it becomes difficult to arrange a small second hand mechanism and a design variation is restricted.

SUMMARY OF THE INVENTION

It is an object of the invention to provide a timepiece attached with a calendar mechanism capable of carrying out a large-sized date indication, having a degree of freedom of a date indicating position, and capable of developing a design variation.

Further, it is another object of the invention to provide a timepiece attached with a calendar mechanism that has a concise structure of a date feeding mechanism and that is easily fabricated.

The invention is characterized in a timepiece attached with a calendar mechanism including two date indicators, the timepiece attached with a calendar mechanism comprising a first date indicator for indicating a position of 1 of a date, and a second date indicator for indicating a position of 10 of the date, wherein the first date indicator comprises a first date indicator wheel portion for rotating the first date indicator by rotation of a top train wheel and a drive cam for rotating the second date indicator and determining a position of the second date indicator. The first date indicator is rotated by 1 pitch per day by way of rotation of an hour wheel rotated by rotation of the top train wheel and a date indicator driving wheel. The second date indicator is rotated at a constant time interval by a date feeding mechanism operated based on rotation of the first date indicator. By the constitution, a timepiece attached with a calendar mechanism capable of carrying out large date indication can be realized. According to the timepiece attached with the calendar mechanism, it is preferable that a rotational center of the first date indicator and a rotational center of the second date indicator are arranged at the same position, and a second date character indicating face of the second date indicator is formed by an open angle equal to or smaller than 90 degrees. The timepiece attached with the calendar mechanism according to the invention is provided with a degree of freedom of a date indicating position and can develop a design variation by being constituted in this way.

It is preferable to constitute the timepiece attached with the calendar mechanism according to the invention such that the first date indicator includes a first character indicating face including 31 pieces of numerals of "1", "1", "2", "3", "4", "5", "6", "7", "8" "9", "0", "1", "2", "3""6", "7", "8", "9", "0", wherein the second date indicator includes a first date character indicating face including numerals of "1", "2", "3", "0", or the second date character indicating face including numerals of "1", "2", "3". According to the constitution, the position of 1 of the date can be indicated by one of the date characters provided at the first date character indicating face, and the position of 10 of the date can be indicated by one of the date characters provided at the second date character indicating face.

It is preferable to constitute the timepiece attached with the calendar mechanism of the invention such that the drive cam provided at the first date indicator includes a cam circular arc portion constituted to be provided with a shape including four concentric circles respectively having different radii, and the second date indicator is constituted to be able to move within a range in a fan-like shape. The timepiece attached with the calendar mechanism of the invention can be constituted to further comprise a drive cam lever including a portion of being brought into contact with the drive cam provided at the first date indicator and a wheel portion brought in mesh with a wheel portion of the second date indicator, a rotation control lever having a wheel portion brought in mesh with a wheel portion of the second date indicator, and a rotation control lever spring for exerting an elastic force to the rotation control lever for restricting rotation of the second date indicator. The drive cam contact portion of the drive cam lever can firmly be brought into contact with the drive cam by a spring force of the rotation control lever spring. By the constitution, a position in a rotational direction of the second date indicator can firmly be determined by a concise mechanism. Further, by adopting the constitution, according to the timepiece attached with the calendar mechanism of the invention, a structure of a date feeding mechanism is concise, an availability of a part is high and fabrication and integration thereof are facilitated.

According to the timepiece attached with the calendar mechanism of the invention, it is preferable that the second date indicator includes the second date character indicating face in a fan-like shape provided with a notch, the second date character indicating face includes 4 pieces of trapezoidal shape portions formed by a pitch interval of (2*360/31) degrees through (3*360/31) degrees, and 3 pieces of notched portions formed by a pitch interval of (2*360/31) degrees through (3*360/31) degrees, and the second date character indicating face is provided with a set of numerals comprising a numeral of "1", a numeral of "2", a numeral of "3", and a numeral of "0". Further, according to the timepiece attached with the calendar mechanism of the invention, it is preferable that the second date indicator includes a second character indicating face in a fan-like shape, the second date character indicating face is provided with a set of numerals comprising a numeral of "1", a numeral of "2", a numeral of "3", and a numeral of "0", and the second date character indicating face is arranged on an inner side of the first date character indicating face. By the constitution, date indication can be carried out by two large date characters and therefore, there can be realized a timepiece attached with a calendar mechanism in which the date indication is easy to see and restriction of design is in considerable.

Further, the timepiece attached with the calendar mechanism of the invention can further includes a second indicating mechanism for indicating information with regard to "second" by a small second hand. In the constitution, it is preferable that a rotational center of a second indicator rotated for indicating a second based on rotation of a top train wheel is arranged on an outer side of a region of moving the second date character indicating face and on an inner side of the first date character indicating face. By the constitution, there can be realized a timepiece attached with a calendar mechanism attached with a small second hand and capable of carrying out large date indication. Further, the timepiece attached with the calendar mechanism of the invention can be constituted to further comprise a train wheel mechanism for indicating information with regard to time, calendar by a small indicating hand, wherein a rotational center of an indicator rotated for indicating the information based on rotation of the top train wheel is arranged on an outer side of a region of moving the second date character indicating face and on an inner side of the first date character indicating face. By the constitution, there can be realized a timepiece attached with a calendar mechanism for indicating information with regard to time, calendar by a small indicator, at the same time, capable of carrying out large date indication.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
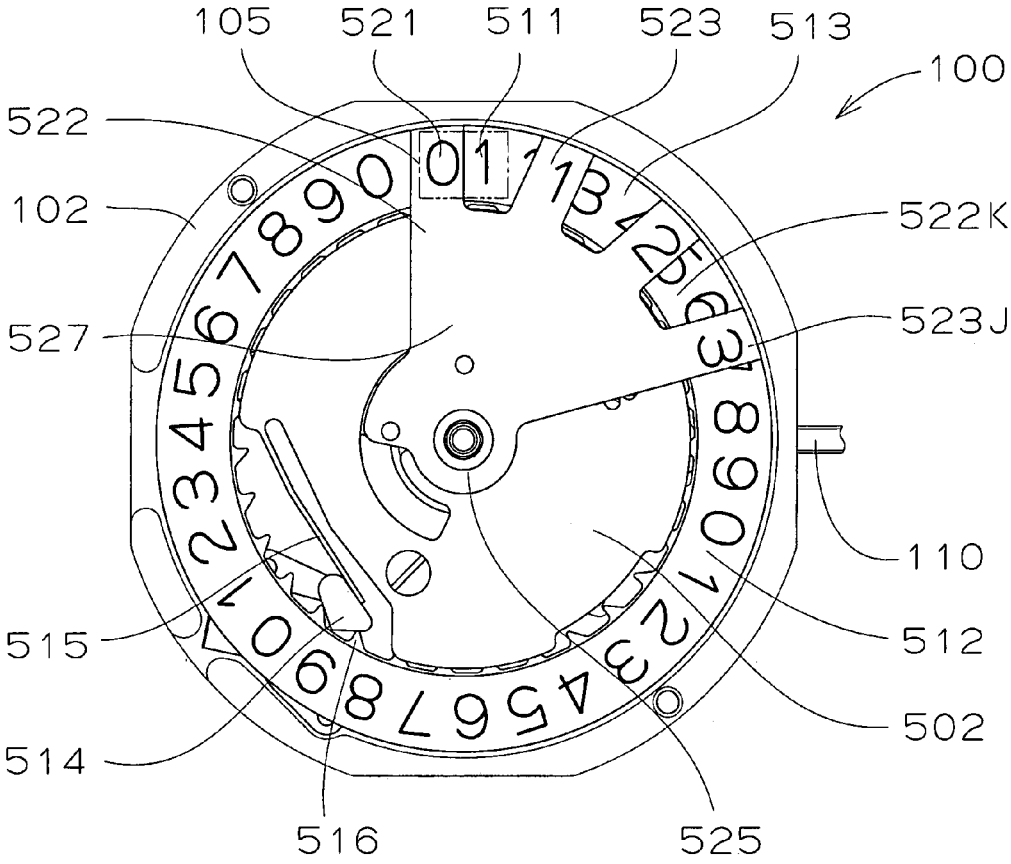
FIG. 1 is an outline plane view showing structures of a first date indicator and a second date indicator and the like in viewing a movement from a dial side according to a first embodiment of the invention.
Figure 2:
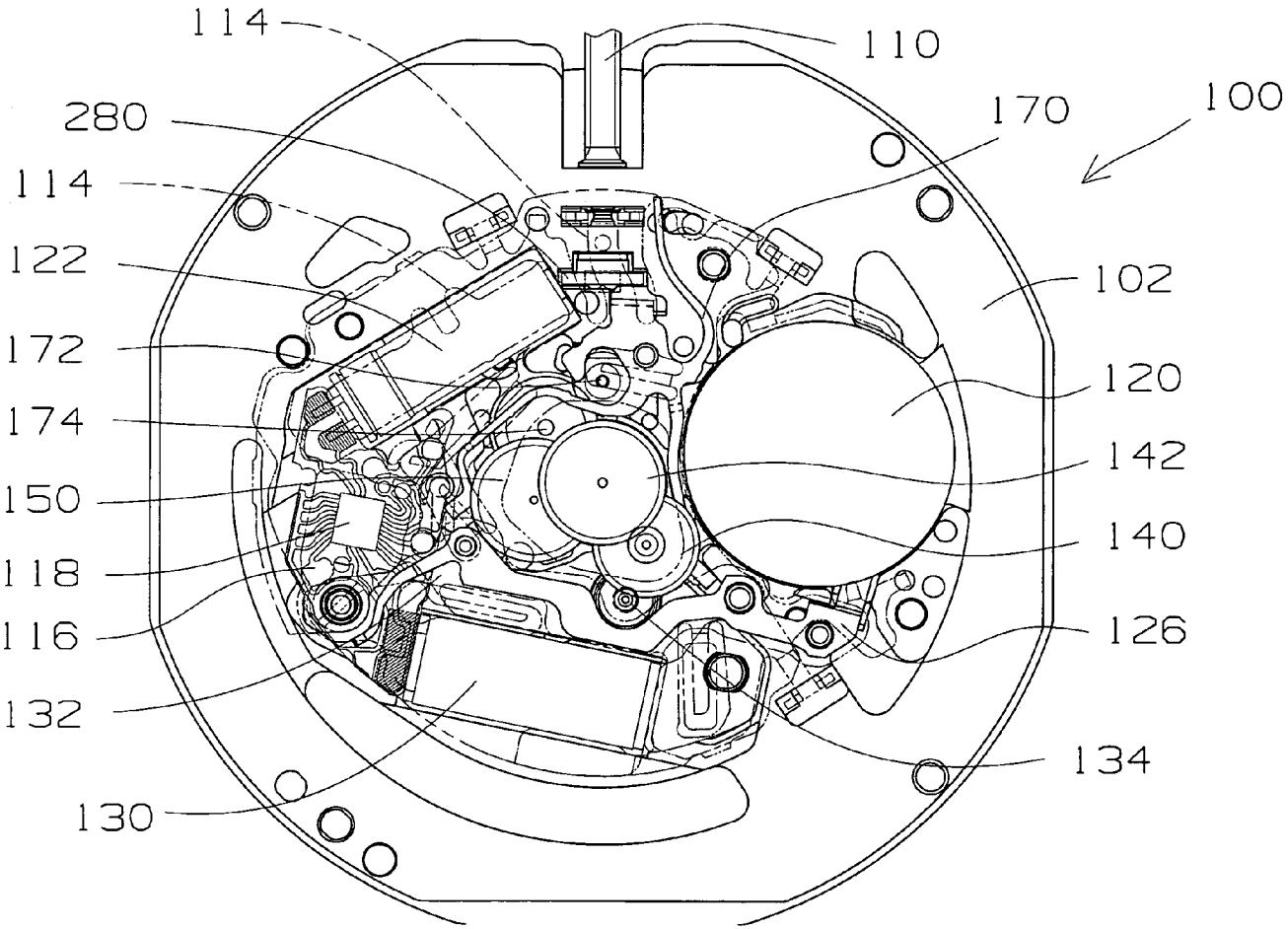
FIG. 2 is an outline plane view showing a structure in viewing the movement from a case back side according to the first embodiment of the invention.

Embodiments of a timepiece attached with a calendar mechanism of the invention will be explained in reference to the drawings as follows.

(1) First Embodiment of the Invention

First, a first embodiment of a timepiece attached with a calendar mechanism of the invention will be explained.

(1-1) Constitution of Movement

In reference to FIG. 1 through FIG. 4, according to a first embodiment of a timepiece attached with the calendar mechanism of the invention, a movement 100 is constituted by an analog electronic timepiece. Although an explanation is given of a constitution of applying a timepiece attached with a calendar mechanism of the invention to an analog electronic timepiece, the invention is applicable not only to an analog electronic timepiece but also to a mechanical type timepiece, that is, a concept of "timepiece attached with calendar mechanism" in the specification is a concept including "analog electronic timepiece", "mechanical type timepiece" and analog timepieces of all other operating principles.

The movement 100 of the timepiece attached with a calendar mechanism of the invention includes a main plate 102 constituting a base plate of the movement. A dial 104 (refer to FIG. 3 and FIG. 4) is attached to a glass side of the movement 100. "Top side" of the movement 100 is arranged with a battery 120, a circuit block 116, a step motor, a top train wheel, a switching apparatus (not illustrated) and the like. The switching apparatus is arranged on "top side" of the movement 100. The switching apparatus can also be arranged on "back side" of the movement 100. The top train wheel is rotated by rotating the step motor. An IC 118 and a crystal oscillator 122 are attached with the circuit block 116. A battery 120 constitutes a power source attached with a calendar mechanism. The crystal oscillator 122 constitutes an oscillation source of the timepiece attached with the calendar mechanism and is oscillated by, for example, 32,768 Hertz.

The top train wheel is rotatably supported by the main plate 102 and a train wheel bridge 112. A circuit holder plate 114 is provided to hold the circuit block 116 relative to the train wheel bridge 112. A battery connection (−) 126 is held by the train wheel bridge 112. An insulating plate (not illustrated) is arranged between the battery connection (−) 126 and the holder plate 114. IC 118 includes an oscillating portion, a dividing portion, a driving portion. The oscillating portion outputs a reference signal based on oscillation of the crystal oscillator 122. The dividing portion divides an output signal of the oscillating portion. The driving portion outputs a motor drive signal for driving the step motor based on an output signal of the dividing portion. The step motor includes a coil block 130, a stator 132, a rotor 134. The coil block 130 rotates the rotor 134 by magnetizing the stator 132 when inputted with the motor drive signal. The rotor 134 is constituted to rotate by, for example, 180 degrees per second.

A second indicator 142 is constituted to rotate based on rotation of the rotor 134 by way of rotation of a fifth wheel & pinion 140. The second wheel 142 is constituted to rotate once per minute. A second hand 144 is attached to the second wheel 142. A fourth wheel & pinion may be used in place of the second hand 142. The second wheel 142 may be arranged at a center of the timepiece, or may be arranged at a position different from the center of the timepiece. A train wheel setting lever 170 is provided for setting a position of the fifth wheel & pinion 140 by being operated to rotate when a hand setting stem 110 is drawn to a second stage.

A third wheel & pinion 150 is constituted to rotate based on rotation of the second indicator 142. A minute indicator 152 is constituted to rotate based on rotation of the third wheel & pinion 150. A center wheel & pinion may be used in place of the minute indicator 152. A minute hand 154 is attached with a center wheel & pinion 152. A slip mechanism is provided to the minute indicator 152. The minute hand 154 and an hour hand 166 can be rotated by rotating the hand setting stem 110 in a state of stopping the second hand 144 when hand setting is carried out. The minute indicator 152 is constituted to rotate by one rotation per hour. A minute wheel 174 is constituted to rotate based on rotation of the minute indicator 152. A clutch wheel 175 is provided to rotate by rotation of the hand setting stem 110 when the hand setting stem 110 is drawn to the second stage. The minute wheel 174 is constituted to rotate by way of rotation of the clutch wheel 175, a setting wheel 177 by rotation of the hand setting stem 110 when the hand setting stem 110 is drawn to the second stage.

A center pipe 103 is provided at the main plate 102. The center pipe 103 is extended to a dial side of the main plate 102 from the case back side of the main plate 102. An hour wheel 160 is provided rotatably to an outer peripheral cylinder face of the center pipe 103. The hour wheel 160 is constituted to rotate based on rotation of the minute wheel 174. The hour wheel 160 is constituted to rotate by one rotation per 12 hours. An hour hand 166 is attached to the hour wheel 160. A date indicator driving wheel & pinion 510 is constituted to rotate by rotating a date indicator driving pinion 161 of the hour wheel 160. The date indicator driving wheel & pinion 510 is provided to rotate by one rotation per day by rotation of the hour wheel 160.

The minute indicator 152 is rotatably supported at inside of a center hole portion of the center pipe 103. An abacus be ad of the second indicator 142 is rotatably supported at inside of a center hole portion of the minute indicator 152. The train wheel bridge 112 is arranged on the case back side of the main plate 102. An upper shaft portion of the rotor 134, an upper shaft portion of the fifth wheel & pinion 140, an upper shaft portion of the second indicator 142, an upper shaft portion of the third wheel & pinion 150, an upper shaft portion of the minute wheel 174 are rotatably supported by the train wheel bridge 112. A lower shaft portion of the rotor 134, a lower shaft portion of the fifth wheel & pinion 140, a lower shaft portion of the third wheel & pinion 150, a lower shaft portion of the minute wheel 174 are rotatably supported by the main plate 102.

(1-2) Constitutions of Switching Mechanism, Hand Setting Mechanism:

Constitutions of the switching mechanism, a hand setting mechanism will be explained as follows. In reference to FIG. 2 and FIG. 3, in the movement 100, the hand setting stem 110 is rotatably integrated to the main plate 102. The hand setting stem 110 includes a front end shaft portion 110A, a first square portion 110B, a first shaft portion 110C, a setting operation shaft portion 110D, a second shaft portion 110E, a second square portion 110F, a third shaft portion 110G, a first abacus be ad portion 110H, a second abacus be ad portion 110J, and a base shaft portion 110K formed successively from a front end side. The setting operation shaft portion 110D of the hand setting stem 110 is integrated to be rotatable relative to a hand setting stem hole of the main plate 102. The base shaft portion 110K of the hand setting stem 110 is integrated to be rotatable relative to a hand setting stem base hole of the main plate 102. It is preferable to constitute an outer diameter of the first abacus be ad portion 110H larger than an outer diameter of the second abacus be ad portion 110J.

The clutch wheel 175 is arranged to include a rotational axis line the same as the rotational axis line of the hand setting stem 110. There is constructed a constitution in which when the hand setting stem 110 is disposed at 0 stage and first stage, a cooperative square hole of the clutch wheel 175 is rotatable relative to the first shaft portion 110C of the hand setting stem 110 and even when the hand setting stem 110 is rotated, the clutch wheel 175 is not rotated. There is constructed a constitution in which when the hand setting stem 110 is disposed at second stage, the cooperative square hole of the clutch wheel 175 is fitted to the first square portion 110B of the hand setting stem 110 and the clutch wheel 175 is rotated based on rotation of the hand setting stem 110. There is constructed a constitution in which when the hand setting stem 110 is disposed at 0 stage, a hand setting stem position determining portion 114F of the circuit holder plate 114 is disposed between the base shaft portion 110K and the second abacus be ad portion 110J. There is constructed a constitution in which when the hand setting stem 110 is disposed at 1 stage, a hand setting stem position determining portion 114F of the circuit holder plate 114 is disposed between the first abacus be ad portion 110H and the second abacus be ad portion 110J. There is constructed a constitution in which when the hand setting stem 110 is disposed at second stage, the hand setting stem position determining portion 114F of the circuit holder plate 114 is disposed between the first abacus be ad portion 110H and the third shaft portion 110G. Therefore, according to the switching apparatus having the above-described constitution, three positions in the axis line direction of the hand setting stem 110 (0 stage, 1 stage, 2 stage) can be positioned by the hand setting position determining portion 114F of the circuit holder plate 114.

The train wheel setting lever 170 is constituted not to set a portion of setting the fifth wheel & pinion 140 without bringing the setting operation shaft portion 110D of the hand setting stem 110 into contact with the train wheel setting lever 170 when the hand setting stem 110 is disposed at 0 stage and when the hand setting stem 110 is disposed at first stage. There is constructed a constitution in which when the hand setting stem 110 is disposed at second stage, the setting operation shaft portion 110D of the hand setting stem 110 is brought into contact with the train wheel setting lever 170 to set the portion of setting the fifth wheel & pinion 140.

Figure 3:
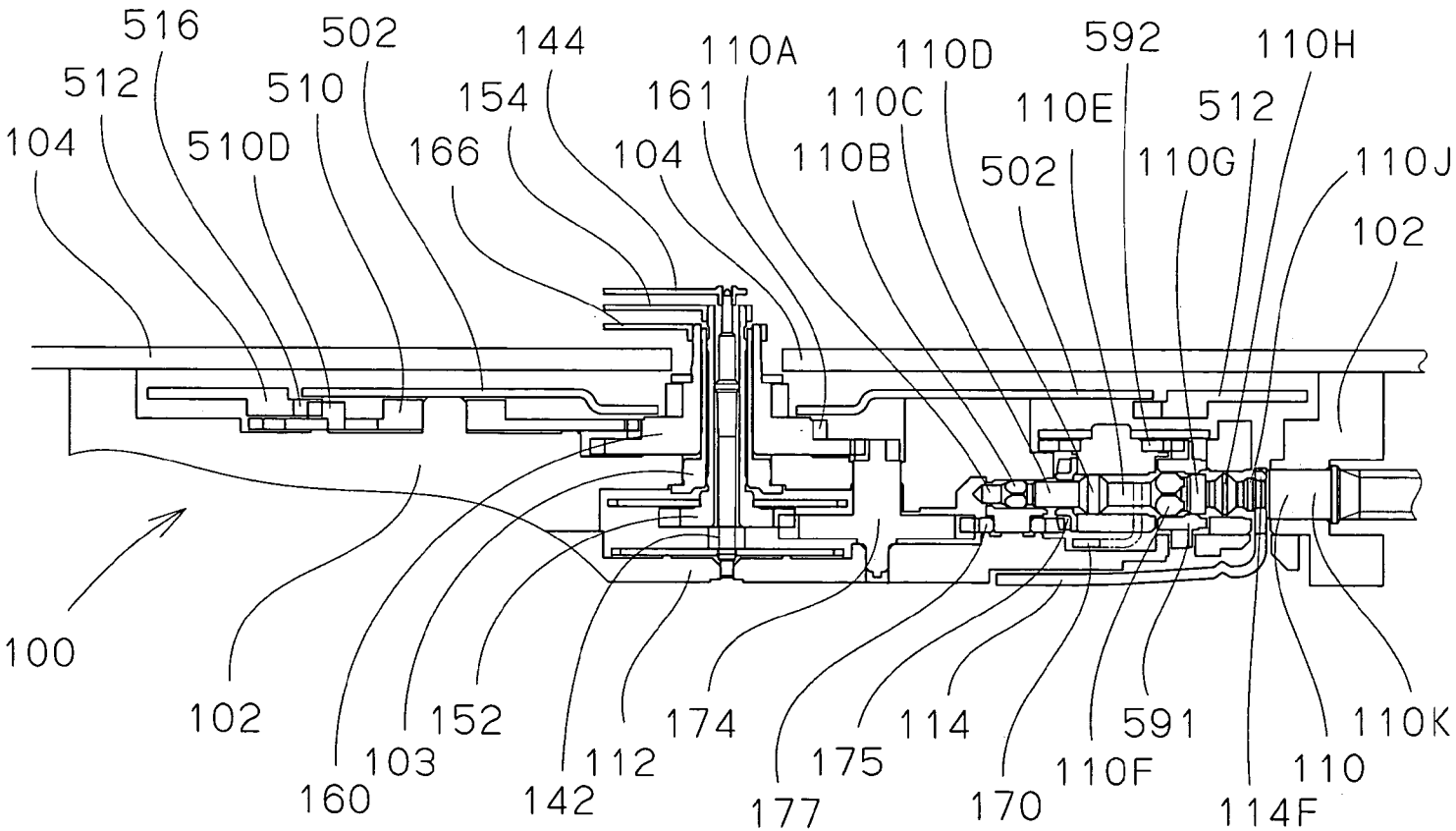
FIG. 3 is a sectional view of a portion showing portions of an indicating hand portion, a switch apparatus and a calendar mechanism according to the first embodiment of the invention.
Figure 4:
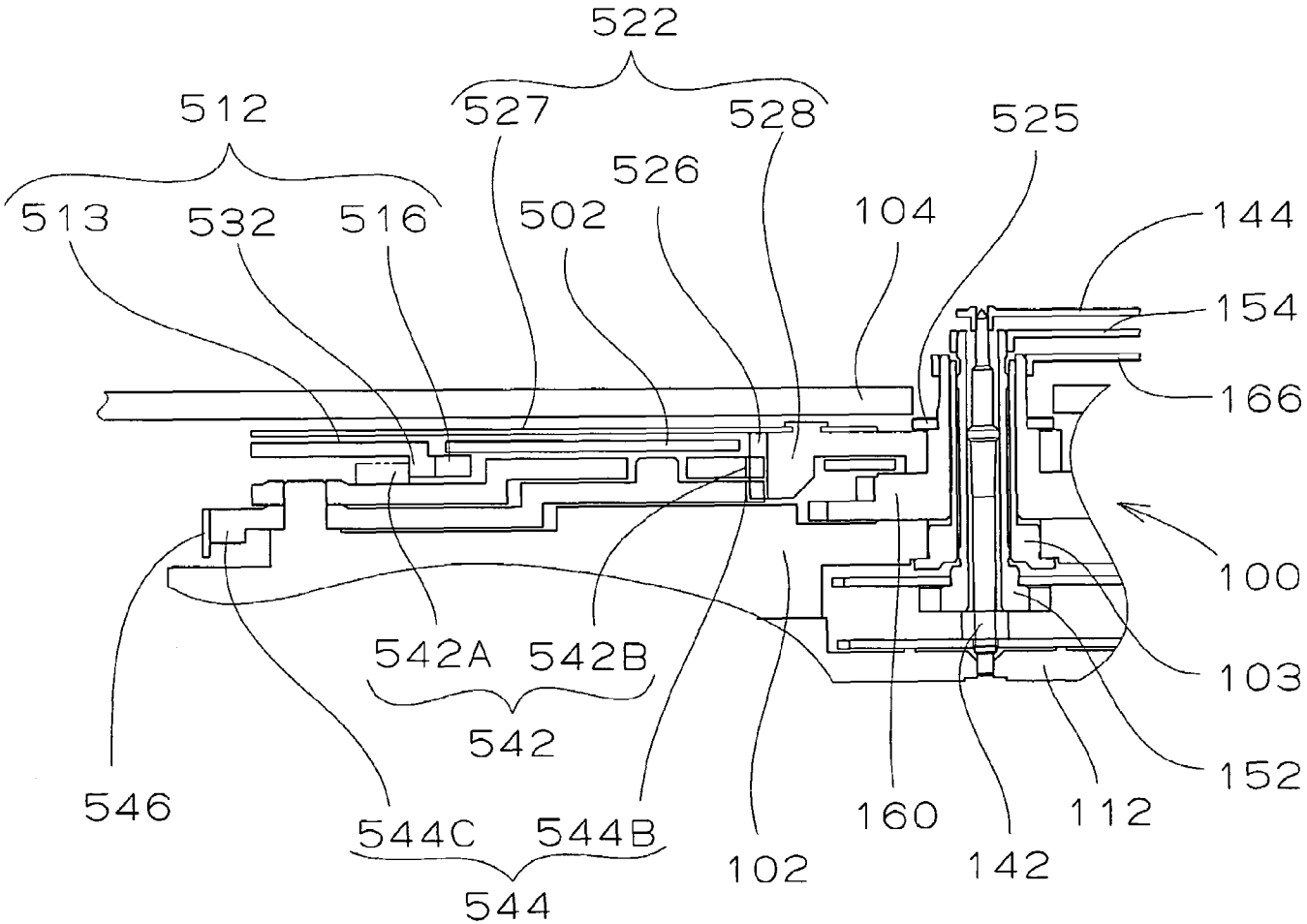
FIG. 4 is a sectional view of a portion showing portions of the indicating hand portion, the calendar mechanism according to the first embodiment of the invention.
Figure 5:
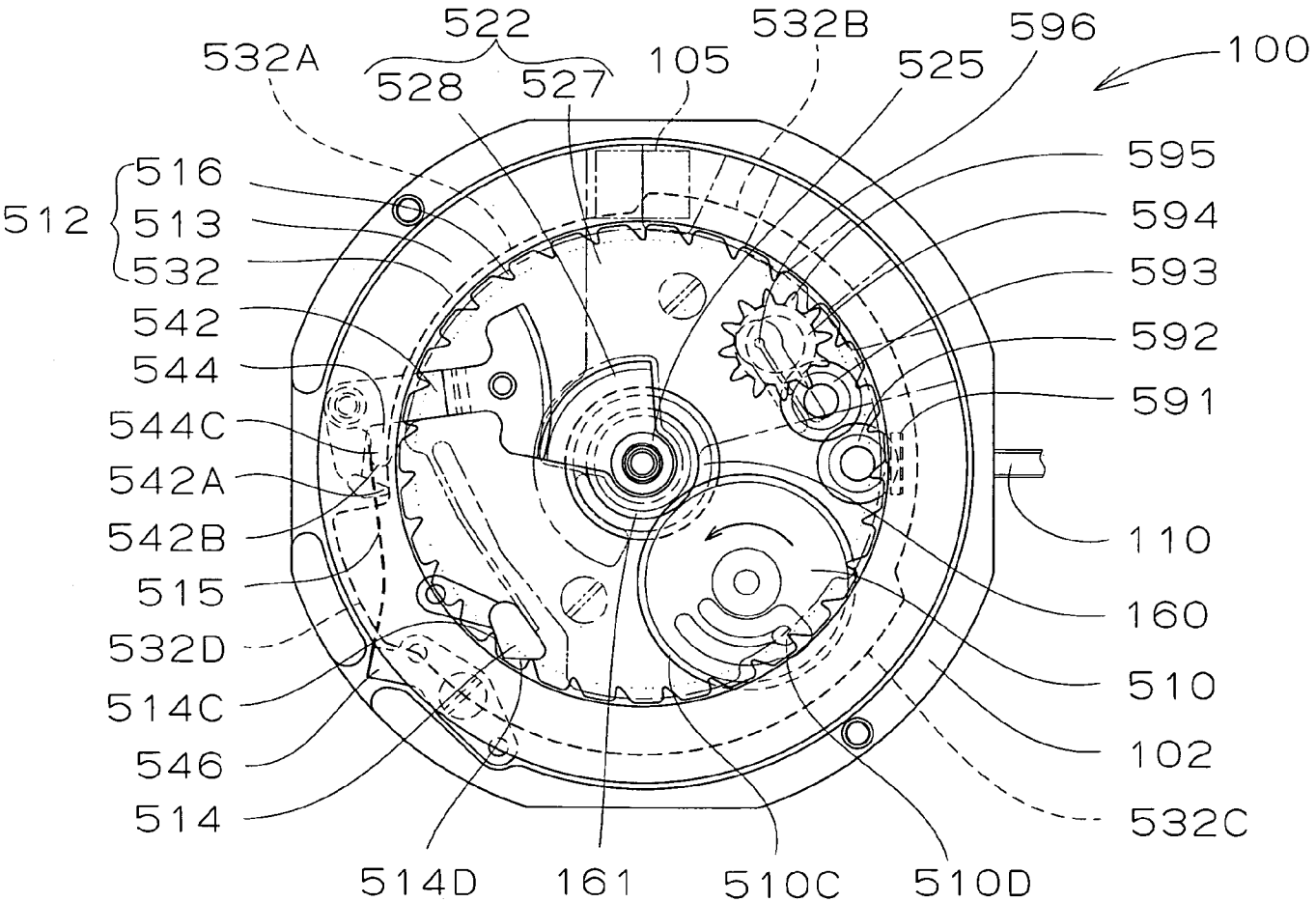
FIG. 5 is a plane view showing the calendar mechanism in viewing the movement from the dial side according to the first embodiment of the invention.

In reference to FIG. 3 and FIG. 5, a first calendar corrector setting wheel 591 is arranged to include a rotational axis line the same as the rotational axis line of the hand setting stem 110. There is constructed a constitution in which when the hand setting stem 110 is disposed at 0 stage, a cooperative round hole of the first calendar corrector setting wheel 591 is rotatable relative to the third shaft portion 110G of the hand setting stem 110, and even when the hand setting stem 110 is rotated, the first calendar corrector setting wheel 591 is not rotated. There is constructed a constitution in which when the hand setting stem 110 is disposed at first stage, the cooperative round hole of the first calendar corrector setting wheel 591 is fitted to the second square portion 110F of the hand setting stem 110, and the first calendar corrector setting wheel 591 is rotated based on rotation of the hand setting stem 110. There is constructed a constitution in which when the hand setting stem 110 is disposed at second stage, the cooperative round hole of the first calendar corrector setting wheel 591 is rotatable relative to the second shaft portion 110E of the hand setting stem 110 and even when the hand setting stem 110 is rotated, the first calendar corrector setting wheel 591 is not rotated. A minute wheel of the minute wheel 174 is arranged to be brought in mesh with the setting wheel 177. The setting wheel 177 is arranged between the main plate 102 and the train wheel bridge 112. A minute wheel & pinion of the minute wheel 174 is constituted to be disposed on the dial side of the main plate 102 to be brought in mesh with an hour wheel of the hour wheel & pinion 160.

(1-3) Constitution of calendar Mechanism:

A constitution of a calendar mechanism will be explained as follows. In reference to FIG. 1 and FIG. 3 through FIG. 5, a date feeding mechanism includes the date indicator driving wheel & pinion 510 and a date jumper 514. The date indicator driving wheel & pinion 510 includes a date indicator driving wheel 510*e*, a date indicator driving wheel finger 5100. A date feed wheel 161 of the hour wheel 160 is brought in mesh with the date indicator driving wheel 510*e*. The date indicator driving wheel & pinion 510 is constituted to rotate by one rotation in 24 hours by rotating the hour wheel 160. A first date indicator 512 for indicating a position of 1 of a date (i.e., units position of the ) is rotatably integrated to the main plate 102. The first date indicator 512 includes a first date character indicating face 513 provided with a first date character 511, a first date wheel teeth portion 516 provided for rotating the first date indicator 512, a drive cam 532 for rotating a second date indicator 522 that indicates a position of 10 of the date (i.e., tens position of the date ). The first date wheel teeth portion 516 is constituted to include 31 pieces of inner teeth. The first date wheel teeth portion 516 is provided for rotating the first date indicator 512 by rotation of the top train wheel. Therefore, there is constructed a constitution in which the date indicator driving finger 5100 is rotated by rotating the date indicator driving wheel 510 by rotation of the hour wheel 160, the first date indicator 512 is rotated by an amount of 1 pitch (one tooth) once per day. The first date indicator 512 can be formed by an engineering plastic of polyarylate or the like, or can be formed by machining a metal of brass or the like.

The drive cam 532 includes a first cam circular arc portion 532A, a second cam circular arc portion 532B, a third cam circular arc portion 532C, a fourth cam circular arc portion 532D constituted to be provided with shapes including four of concentric circles respectively having different radii. A radius of the first cam circular arc portion 532A is the smallest. A radius of the second cam circular arc portion 532B is larger than the radius of the first cam circular arc portion 532A and smaller than the radius of the third cam circular arc portion 532C. The radius of the third cam circular arc portion 532C is larger than the radius of the second cam circular arc portion 532B and smaller than the radius of the fourth cam circular arc portion 532D. The radius of the fourth cam circular arc portion 532D is the largest. An open angle of the first cam circular arc portion 532A can be constituted by, for example, 95 degrees. An open angle of the second cam circular arc portion 532B can be constituted by, for example, 110 degrees. An open angle of the third cam circular arc portion 532C can be constituted by, for example, 110 degrees. An open angle of the fourth cam circular arc portion 532 D can be constituted by, for example, 24 degrees. Alleviating curve portions are provided among the respective cam circular arc portions. The alleviating curve portion can be constituted to include one or more of curve portions. Or, the alleviating curve portion may be constituted to include one or more of curve portions and one or more of linear portions. By the constitution, a drive cam lever 542 (mentioned later) can be operated by being firmly and smoothly brought into contact with the drive cam 532.

A first date indicator holder 502 is provided to hold the first date indicator teeth portion 516 of the first date indicator 512 to be rotatable relative to the main plate 102. The first date indicator holder 502 can be formed by an elastic metal of phosphor bronze or the like. The date indicator driving wheel 510 is arranged between the main plate 102 and the first date indicator holder 502. A portion of a vicinity of a center hole of the date indicator holder 502 holds an inner side portion of the date wheel 161 of the hour wheel & pinion 160 rotatably relative to the main plate 102. A date jumper 514 is rotatably integrated to the main plate 102. A hole portion of a rotational center of the date jumper 514 is arranged between the main plate 102 and the first date indicator 512. The date jumper 514 includes setting portions 514C, 514D for setting the first wheel teeth portion 516. A date jumper spring 515 is formed at the date wheel holder 502. The setting portions 514C, 514D of the date jumper 514 are constituted to simultaneously set two of the first date wheel teeth portions 516 by bringing the date jumper 514 into contact with the first date wheel teeth portions 516 by the date jumper spring 515.

The movement 100 further includes the second date indicator 522 for indicating a position of 10 of a date and a second date indicator holder 525 for holding the second date indicator 522. The second date indicator holder 525 can be formed by an elastic metal of phosphor bronze or the like. The second date indicator 522 includes a second date character indicating face 523 provided with a second date character 521, a second date indicator teeth portion 526 provided for rotating the second date indicator 522. The second date indicator 522 is constituted by a second date plate 527 and a second date plate wheel 528. A second date character indicating face 523 can be provided at the second date plate 527, the second date indicator teeth portion 526 can be provided at the second plate wheel 528. The second date indicator teeth portion 526 can be formed by an open angle between 90 degrees through 170 degrees. The second date plate wheel 528 can be constituted by an engineering plastic of polyacetal or the like. The second date plate 527 is formed by a metal of aluminum or the like or a plastic of polyester film or the like. The second date indicator holder 525 can be provided for holding the second date indicator 522 rotatably relative to the hour wheel 160. The second date indicator holder 525 can be fixed to the hour wheel 160 by being constituted by a C-ring shape.

It is preferable to arrange a rotational center of the first date indicator 512 and a rotational center of the second date indicator 522 to be disposed at the same position. It is preferable to arrange the rotational center of the first date indicator 512 and the rotational center of the second date indicator 522 at a position the same as that of a rotational center of the hour wheel 160. The movement 100 further includes a drive cam lever 542, a rotation control lever 544, a rotation control lever spring 546. The drive cam lever 542 and the rotation control lever 544 can be formed by an engineering plastic of polyacetal or the like. The rotation control lever spring 546 can be formed by an elastic metal of phosphor bronze or the like. It is preferable that a rotational center of the drive cam lever 542 and a rotational center of the rotation control lever 544 are disposed at the same position. According to the constitution, a second date indicator jumper for determining a position of the second date indicator in a rotational direction is not needed and therefore, the position in the rotational direction of the second date indicator can firmly be determined by a concise mechanism. That is, according to the constitution, there is not a concern of exerting unnecessary force to the hour wheel 160 by a second date indicator jumper and therefore, the structure of the date feeding mechanism is concise and operation is stabilized. Further, by the constitution, the timepiece attached with the calendar mechanism easy to be fabricated can be realized.

The drive cam lever 542 includes a cam contact portion 542A brought into contact with the first cam circular arc portion 532A through the fourth cam circular arc portion 532D of the drive cam 532, and a wheel portion 542B brought in mesh with the wheel portion 526 of the second date indicator 522. The wheel portion 542B of the drive cam lever 542 can be formed by an open angle between 30 degrees to 60 degrees. The rotation control lever 544 includes a wheel portion 544B brought in mesh with the wheel portion 526 of the second indicator 522, and a spring contact portion 544C brought into contact with the rotation control lever spring 546. The rotation control lever spring 546 is constituted to exert an elastic force to the rotation control lever 544 for setting rotation of the second date indicator 522. In FIG. 5, the rotation control lever spring 546 is constituted to exert a force for rotating the rotation control lever 544 in the counterclockwise direction to the rotation control lever 544. When a force of rotating in the counterclockwise direction is exerted to the rotation control lever 544, a force of rotating the second date indicator 522 in the clockwise direction is generated, and a force of rotating the drive cam lever 542 in the counterclockwise direction is exerted and therefore, a cam contact portion of the drive cam lever 542 is always brought into contact with the drive cam 532. By the constitution, the drive cam lever 542 is brought into contact with the drive cam 532 to determine the position in the rotational direction of the second date indicator 522 and therefore, rotation of the second date indicator 522 is carried out within a range of a fan shape constituting the rotational center by the rotational center of the first date indicator 512.

In reference to FIG. 1 and FIG. 5, in a case of a constitution formed with a date window 105 in "12 o'clock direction" of the dial 104, the first date indicator 512 includes the first date character indicating face 513 in the ring-like shape. 4 pieces of the numerals comprising the first date character 511 are provided at the first date character indicating face 513. The first date characters 513 include 4 sets of numerals. That is, the first date characters 511 include numerals of "1" through "9" and "0" constituting a first set of the first date characters, numerals of "1" through "9" and "0" constituting a second set of the first date characters, numerals of "1" through "9" and "0" constituting a third set of the first date characters, and a numeral of "1" constituting a fourth set of the first date character. That is, the first date characters 511 include 31 pieces of numerals of "1", "1", "2", "3", "4", "5", "6", "7", "8", "9," "0", "1", "2", "3", "4", "5", "6", "7", "8", "9", "0", "1", "2", "3", "4", "5", "6", "7", "8", "9", "0". 31 pieces of the numerals constituting the first date characters 511 are arranged at the first character indicating face 511 at equal angular intervals, that is, at intervals of (360/31) degrees. The respective first date characters 511 are arranged such that upper sides of the characters are directed in "12 o'clock direction" of the movement 100 when arranged at inside of the date window 105 of the dial 104. In a state shown in FIG. 1, the date window 105 of the dial 104 is arranged with "1" of "1" and "1" arranged contiguously to each other in the first date characters 511 proximate to "2".

The second date indicator 522 includes the second date character indicating face 523 provided with 3 pieces of notched portions and formed in a fan-like shape. It is preferable to form the second date character indicating face 532 by an open angle of 80 degrees through 160 degrees. By the constitution, inside of the movement can effectively be arranged with an additional indicating mechanism of a mechanism of indicating second by the small second hand. The second date character indicating face 523 includes 4 pieces of trapezoidal shape portions 523J respectively formed by constant pitch intervals, and 3 pieces of notched portions 522K respectively formed by constant pitch intervals. It is preferable that the pitch interval of the trapezoidal shape portion 523J falls in a range of (2*360/31) degrees through (3*360/31) degrees. It is preferable that the pitch interval of the notched portion 522K falls in a range of (2*360/31) degrees through (3*360/31) degrees. Each notched portion 522K is arranged between 2 pieces of the trapezoidal shape portions 523J. The second date character indicating face 523 is arranged at a position more proximate to the dial 104 than the first date character indicating face 513.

4 pieces of numerals, that is, the second date characters 521 comprising "0", "1", "2", "3" are provided at the second date character indicating face 523. The respective numerals are arranged at the second date character indicating face 521 by angular intervals equal to each other. That is, it is further preferable to arrange a numeral of "0" and a numeral of "1" at an interval of a range of (2*360/31) degrees through (2.5*360/31) degrees. It is further preferable to arrange the numeral of "1" and the numeral of "2" at an interval of a range of (2*360/31) degrees through (2.5*360/31) degrees. It is further preferable to arrange the numeral of "2" and the numeral of "3" at an interval of a range of (2*360/31) degrees through (2.5*360/31) degrees. The respective second date characters 521 are arranged such that upper sides of the characters are directed in "12 o'clock direction" of the movement 100 when arranged at inside of the date window 105 of the dial 104. As a modified example, instead of providing the numeral of "0", there can be constructed also a constitution in which a position thereof is constituted by a portion of "white paper" (that is, a solid portion which is not provided with any numerals). As a modified example, the second date character indicating face 523 can be provided with the second date characters 521 comprising 2 sets of numerals arranged at angular intervals similar to those of the above-described, that is, "0", "1", "2", "3", "0", "1", "2", "3". Further, as a modified example, the second date character indicating face 523 can also be provided with the second date characters 521 comprising 3 sets of numerals arranged at similar angular intervals, that is, "0", "1", "2", "3", "0", "1", "2", "3", "0", "1", "2", "3". In the state shown in FIG. 1, "0" of the second date character 521 is arranged at a left side portion of the date window 105 of the dial 104, "1" of the first date character 511 is arranged at the date window 105 of the dial 104 under the notched portion of the second date indicator 522 to indicate "01 day" at inside of the date window 105.

Figure 11:
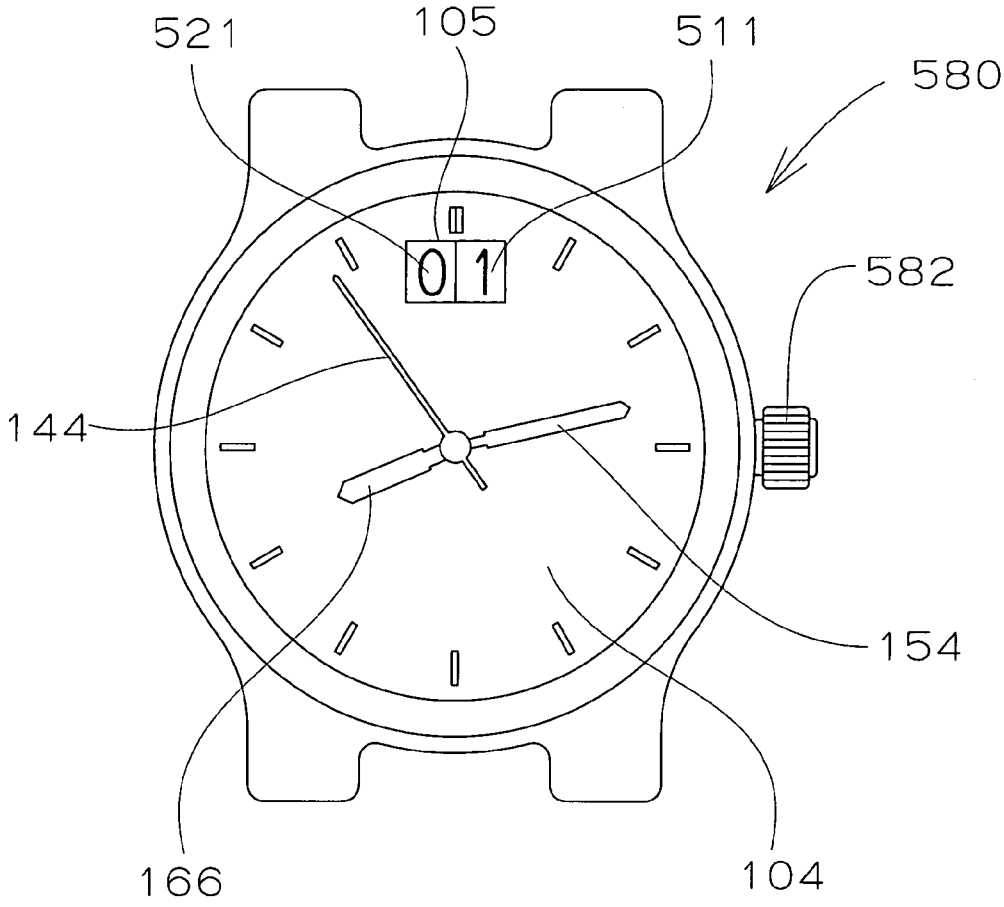
FIG. 11 is a plane view showing a complete in a constitution of arranging a date window in "12 o'clock direction" of a dial according to the first embodiment of the invention.

In reference to FIG. 11, a complete 580 of the timepiece attached with the calendar mechanism of the invention is formed by the date window 105 in "12 o'clock direction" of the dial 104. The left side portion of the date window 105 of the dial 104 is arranged with "0" of the second date character 521 of the second date indicator 522, and the right side portion of the date window 105 is arranged with the notched portion 522K of the second date indicator 522 and "1" of the first date characters 511. Therefore, the complete 580 indicates "1 day". Time information is indicated by the second-hand 144, the minute hand 154, the hour hand 166. When time is corrected, or calendar indication is corrected or the like, operation of pushing and pulling the hand setting stem 110 and operation of rotating the hand setting stem 310 can be carried out by operating "crown 582" integrally rotated with the hand setting stem 110.

FIG. 1 is a plane view of a portion showing a back side structure of the movement 100 viewed from the dial side in a state before rotating the first date indicator 512 (that is, state before date feeding) in the timepiece attached with a calendar mechanism of the invention. In reference to FIG. 1 and FIG. 5, the setting portions 514C, 514D of the date jumper 514 sets the first date indicator teeth portion 516 of the first date indicator 512. The front end portion of the cam contact portion 542A of the drive cam lever 542 is brought into contact with the first cam circular arc portion 532A of the drive cam 532. The date character indicated from the date window 105 by the first date indicator 512 is "1". The date character indicated from the date window 105 by the second date indicator 522 is "0". That is, current date, "01 day" is indicated from the date window 105 by the first date indicator 512 and the second date indicator 522. In a state shown in FIG. 5, "02 day" can be indicated by rotating the first date indicator 512 by 1 pitch by rotating the date indicator driving wheel 510 in a direction indicated by an arrow mark (counterclockwise direction) by rotating the hour wheel 160.

Figure 6:
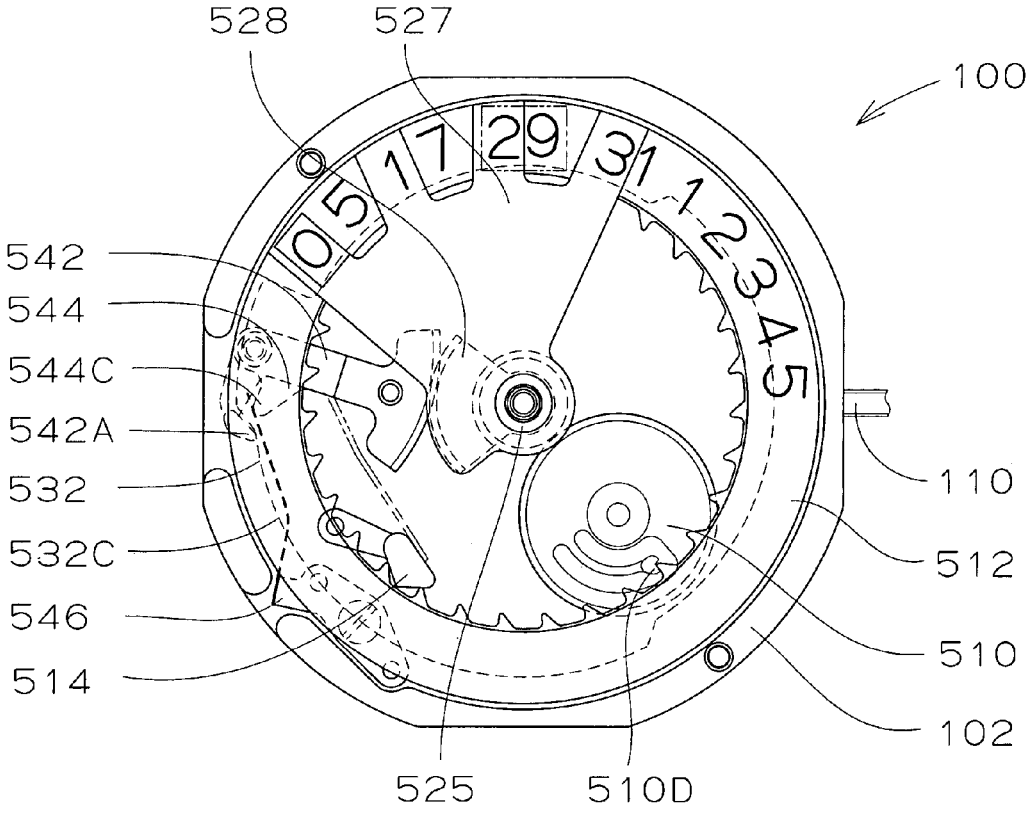
FIG. 6 is a plane view showing a first date indicator, a second date indicator, a date indicator driving wheel and the like in a state of indicating "29 day" according to the first embodiment of the invention.

FIG. 6 is a plane view of a portion showing a structure of the back side of the movement 100 viewed from the dial side in a state before rotating the first date indicator 512 (that is, state before date feeding) in the timepiece attached with the calendar mechanism of the invention. In reference to FIG. 6, the front end portion of the cam contact portion 542A of the drive cam lever 542 is brought into contact with the third cam circular arc portion 532C of the drive cam 532. A date character indicated from the date window 105 by the first date indicator 512 is "9". The date character indicated from the date window 105 by the second date indicator 522 is "2". That is, current date, "29 day" is indicated from the date window 105 by the first date indicator 512 and the second date indicator 522. In a state shown in FIG. 6, "30 day" can be indicated as shown by FIG. 7 by rotating the first date indicator 512 by 1 pitch by rotating the date indicator driving wheel 5.10 in a direction indicated by an arrow mark (counterclockwise direction) by rotating the hour wheel 160.

Figure 7:
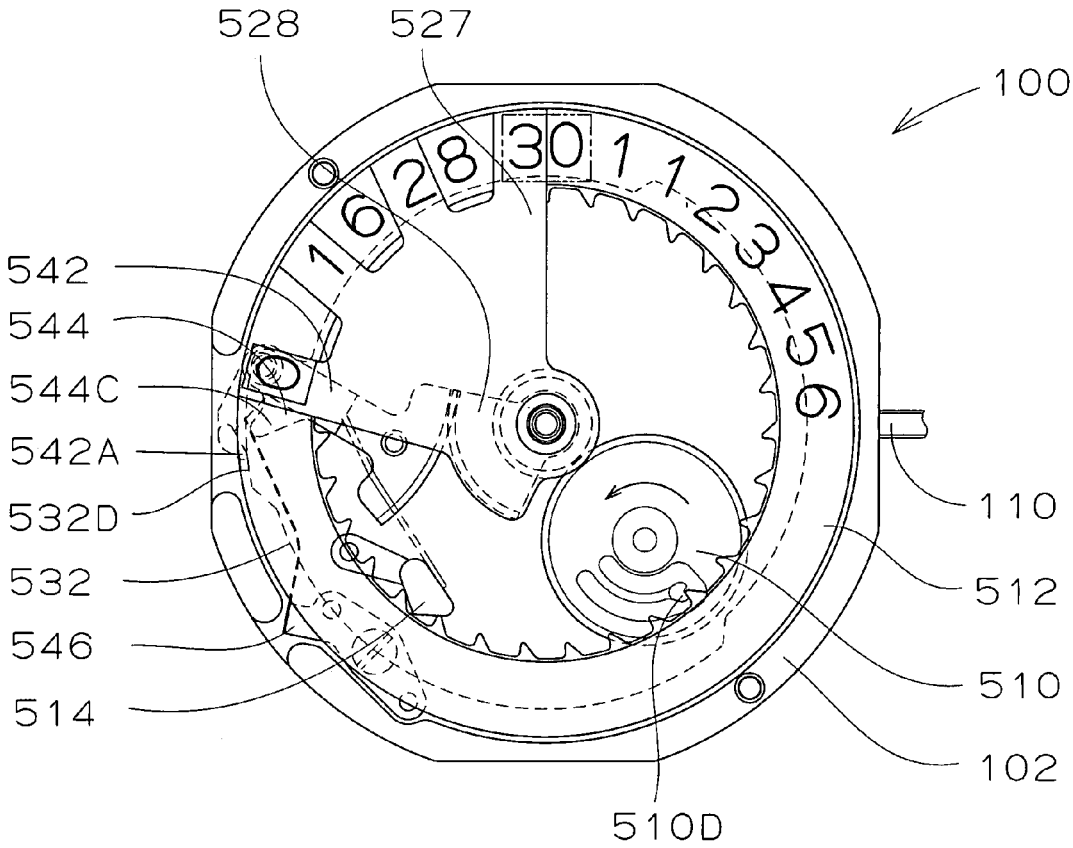
FIG. 7 is a plane view showing the first date indicator, the second date indicator, the date indicator driving wheel and the like in a state of indicating "30 day" according to the first embodiment of the invention.
Figure 8:
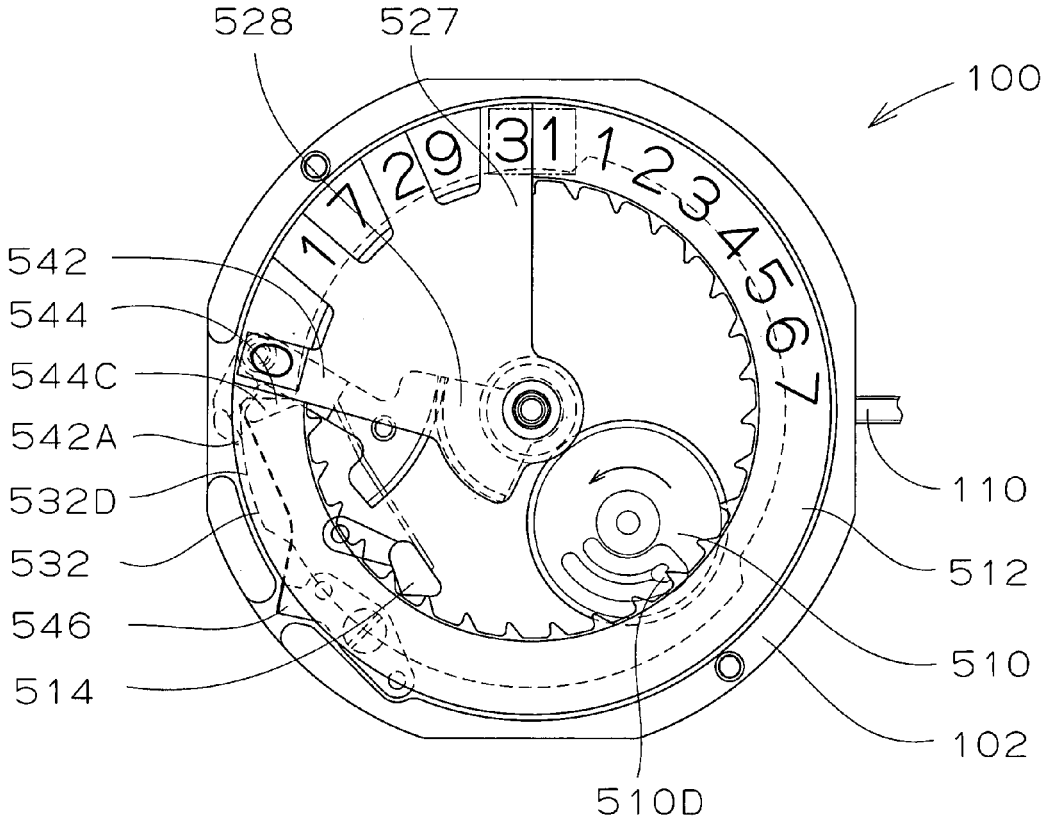
FIG. 8 is a plane view showing the first date indicator, the second date indicator, the date indicator driving wheel and the like in a state of indicating "31 day" according to the first embodiment of the invention.
Figure 9:
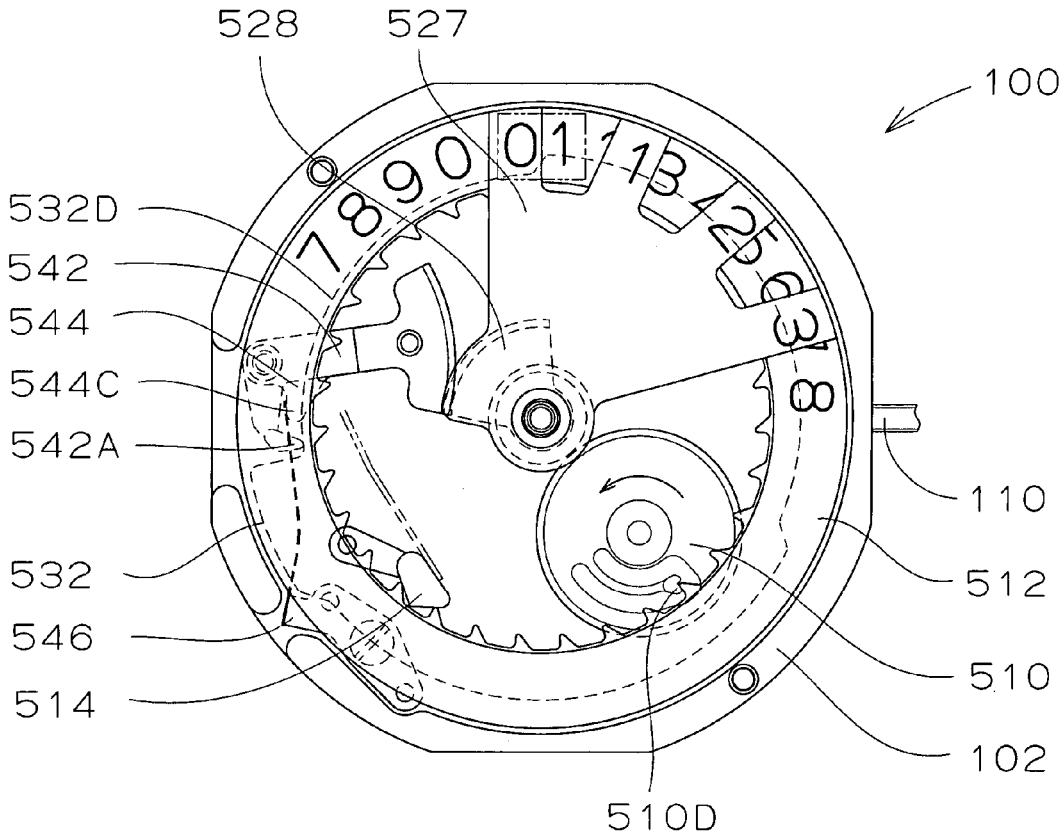
FIG. 9 is a plane view showing the first date indicator, the second date indicator, the date indicator driving wheel and the like in a state of indicating "1 day" according to the first embodiment of the invention.
Figure 10:
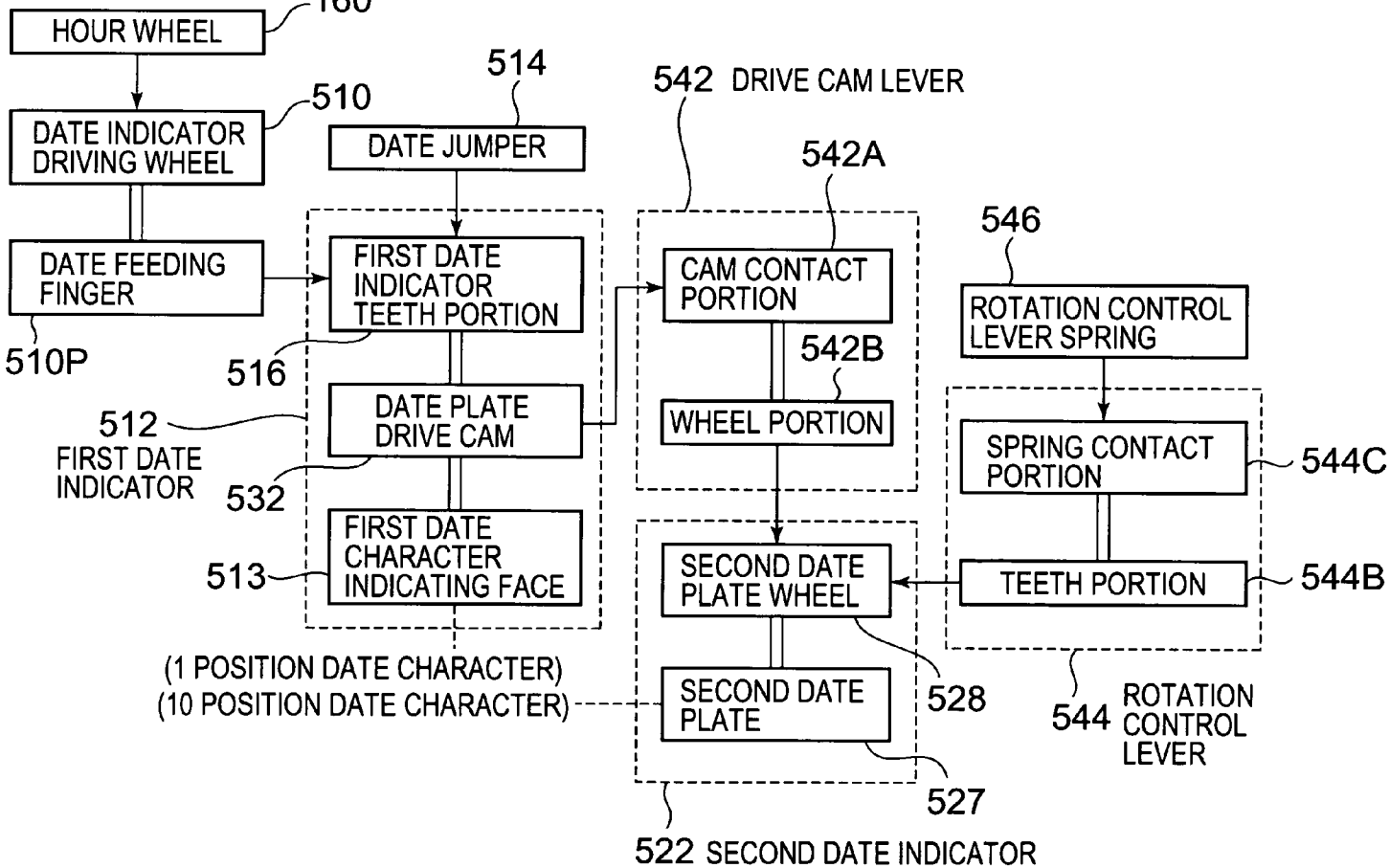
FIG. 10 is a block diagram showing a top train wheel, the calendar mechanism and the like according to the first embodiment of the invention.

In reference to FIG. 7, the front end portion of the cam contact portion 542A of the drive cam lever 542 is brought into contact with the fourth cam circular arc portion 532D of the drive cam 532. In a state shown in FIG. 7, "31 day" can be indicated as shown by FIG. 8 by rotating the first date indicator 512 by 1 pitch by rotating the date indicator driving wheel 510 in a direction indicated by an arrow mark (counterclockwise direction) by rotating the hour wheel 160. In reference to FIG. 8, the front end portion of the contact portion 542A of the drive cam lever 542 is brought into contact with the fourth cam circular arc portion 532D of the drive cam 532. In a state shown in FIG. 8, "01 day" can be indicated as shown by FIG. 9 by rotating the first date indicator 512 by 1 pitch by rotating the date indicator driving wheel 510 in a direction indicated by an arrow mark (counterclockwise direction) by rotating the hour wheel 160. In reference to FIG. 9, the front end portion of the cam contact portion 542A of the drive cam lever 542 is brought into contact with the first cam circular arc portion 532A of the drive cam 532.

(1-4) Constitution of Calendar Correcting Mechanism:

In reference to FIG. 3 and FIG. 5, the calendar correcting mechanism includes a first intermediate date corrector setting wheel 591, a second intermediate date corrector setting wheel 592, a third intermediate date corrector setting wheel 593, a fourth intermediate date corrector setting wheel 594, a date corrector setting wheel 595, and a date corrector setting wheel spring 596. The date corrector setting wheel spring 596 can be formed integrally with the first date indicator holder 502. The date corrector setting wheel spring 596 is constituted to press the date corrector setting wheel 595 to the main plate 102. The fourth intermediate date corrector setting wheel 594 is integrally formed with the date corrector setting wheel 595. The date corrector setting wheel 595 is constituted to be able to pivot along a guide hole provided at the main plate 102. There is constructed a constitution in which in a state in which the hand setting stem 110 is disposed at first stage, a cooperative hole of the first intermediate date corrector setting wheel 591 is fitted with the second square portion 110F of the hand setting stem 110, and the first intermediate date corrector setting wheel 591 is rotated based on rotation of the hand setting stem 110.

There is constructed a constitution in which when the hand setting stem 110 is rotated in a first direction under the state, the second intermediate date corrector setting wheel 592 is rotated based on rotation of the first intermediate date corrector setting wheel 591. There is constructed a constitution in which the third intermediate date corrector setting wheel 593 is rotated based on rotation of the second intermediate date corrector setting wheel 592. There is constructed a constitution in which the fourth intermediate date corrector setting wheel 594 and the date corrector setting wheel 595 are rotated based on rotation of the third intermediate date corrector setting wheel 593. There is constructed a constitution in which the date corrector setting wheel 595 is pivoted to a position of being brought in mesh with the first date indicator teeth portion 516 of the first date indicator 512 to stop based on rotation of the third intermediate date corrector setting wheel 593 and the date corrector setting wheel 595 is rotated to the corrected position. There is constructed a constitution in which when the date corrector setting wheel 595 is rotated at the corrected position, the first date wheel 512 can be rotated in the counterclockwise direction.

(1-5) Operation of Normal Hand Movement:

Next, operation of normal hand movement of the timepiece attached with the calendar mechanism of the invention will be explained. In reference to FIG. 2 through FIG. 4, the battery 120 constitutes the power source of the timepiece. The crystal oscillator contained in the crystal unit 122 is oscillated by, for example, 32,768 Hertz. Based on the oscillation of the crystal oscillator, an oscillating portion included in the integrated circuit 118 outputs a reference signal, and the dividing control portion divides the output signal of the oscillating portion. The motor drive portion outputs a motor drive signal for driving the step motor to the coil block 130 based on the output signal to the diving control portion. When the coil block 130 is inputted with the motor drive signal, the stator 132 is magnetized to rotate the rotor 134. The rotor 134 is rotated by, for example, 180 degrees per second. Based on rotation of the rotor 134, the second indicator 142 is rotated by way of rotation of the fifth wheel & pinion 140. The second indicator 142 is rotated by once per minute. "Second" of time information is indicated by the second hand 144 attached to the second indicator 142.

The third wheel & pinion 150 is rotated based on rotation of the second indicator 142. The minute indicator 152 is rotated based on rotation of the third wheel & pinion 150. The minute indicator 152 is rotated once per hour. "Minute" of time information is indicated by the minute hand 154 attached to the minute indicator 152. In setting hands, the minute hand 154 and the hour hand 166 can be rotated by rotating the hand setting stem 110 in a state of stopping the second hand 144 by setting the setting portion of the fifth wheel & pinion 140 by the train wheel setting lever 170. The minute wheel 174 is rotated based on rotation of the minute indicator 152. The hour wheel 160 is rotated based on rotation of the minute wheel 174. The hour wheel 160 is rotated once per 12 hours. "Hour" of time information is indicated by the hour hand 166 attached to the hour wheel 160.

(1-6) Operation of Date Feeding:

Next, operation of date feeding of the timepiece attached with the calendar mechanism of the invention will be explained. In reference to FIG. 1, FIG. 3, FIG. 4, FIG. 5 and FIG. 10, the front end portion of the cam contact portion 542A of the drive cam lever 542 is brought into contact with the first cam circular arc portion of the drive cam 532 having the smallest radius. The date character indicated from the date window 105 by the first date indicator 512 is "1". The date indicator indicated from the date window 105 by the second date indicator 522 is "0". In a state shown in FIG. 5, "02 day" can be indicated by rotating the date indicator driving wheel 510 in the direction indicated by the arrow mark (counterclockwise direction) by rotating the hour wheel 160 and rotating the first date indicator 512 by 1 pitch. Further, when the date indicated by the driving wheel 510 is rotated in the direction indicated by the arrow mark (counterclockwise direction) by rotating the hour wheel 160, "03 day" can be indicated by rotating the first date wheel 512 by 1 pitch. Similarly, "04 day" through "09 day" can be indicated by rotating the first date indicator 512 without rotating the second date indicator 522. When the date character indicated from the date window 105 by the second date indicator 522 is "0", always, the front end portion of the cam contact portion 542A of the drive cam lever 542 is brought into contact with the first cam circular arc portion of the drive cam 532.

In reference to FIG. 6, the front end portion of the cam contact portion 542A of the drive cam lever 542 is brought into contact with the third cam circular arc portion of the drive cam 532 having the second largest radius. Current date, "29 day" is indicated from the date window 105 by the first date indicator 512 and the second date indicator 522. In a state shown in FIG. 6, the first date indicator 512 is rotated by 1 pitch by rotating the date indicator driving wheel 510 in a direction indicated by an arrow mark (counterclockwise direction) by rotating the hour wheel 160 and the date character indicated from the date window 105 by the first indicator 512 is changed to "0". When the first date indicator 512 is rotated in this way, the front end portion of the cam contact portion 542A of the drive cam lever 542 is brought into contact with the fourth cam circular arc portion from the third cam circular arc portion by way of the alleviating curve at the drive cam 532. Operation of bringing the front end portion of the cam contact portion 542A into contact with the drive cam 532 is ensured by an elastic force of the rotation control lever 544 and the rotation control lever spring 546. When the front end portion of the cam contact portion 542A of the drive cam lever 542 is brought into contact with the fourth cam circular arc portion of the drive cam 532, the date character indicated from the date window 105 by the second date indicator 522 is changed from "2" to "3". Therefore, as shown by FIG. 7, current date, "30 day" can be indicated from the date window 105 by the first date indicator 512 and the second date indicator 522.

In reference to FIG. 7, in a state shown in FIG. 7, the date character indicated from the date window 105 by the first date indicator 512 is changed to "1" by rotating the first date indicator 512 by 1 pitch by rotating the date indicator driving wheel 510 in the direction indicated by the arrow mark (counterclockwise direction) by rotating the hour wheel 160. When the first date indicator 512 is rotated in this way, the front end portion of the cam contact portion 542A of the drive cam lever 542 stays to be brought into contact with the fourth cam circular arc portion at the drive cam 532. At this occasion, the date character indicated from the date window 105 by the second date indicator 522 stays to be "3". Therefore, as shown by FIG. 8, current date, "31 day" can be indicated from the date window 105 by the first date indicator 512 and the second date indicator 522.

In reference to FIG. 8, in a state shown in FIG. 8, the date character indicated from the date window 105 by the first date indicator 512 is changed from "1" to other one of "1" arranged successive to the "1" by rotating the first date indicator 512 by 1 pitch by rotating the date indicator driving wheel 510 in the direction indicated by the arrow mark (counterclockwise direction) by rotating the hour wheel 160. When the first date indicator 512 is rotated in this way, the front end portion of the cam contact portion 542A of the drive cam lever 542 is brought into contact with the first cam circular arc portion from the fourth cam circular arc portion by way of the alleviating curve in the drive cam 532. Operation of bringing the front end portion of the cam contact portion 542A into contact with the drive cam 532 is ensured by the elastic force of the rotation control lever 544 and the rotation control lever spring 546. When the front end portion of the cam contact portion 542A of the drive cam lever 542 is brought into contact with the first cam circular arc portion of the drive cam 532, the date character indicated from the date window 105 by the second date indicator 522 is changed from "3" to "0". Therefore, as shown by FIG. 9, current date, "01 day" can be indicated from the date window 105 by the first date indicator 512 and the second date indicator 522. In the above-described operation, a rotational angular range of the drive cam lever 542 is 37.5 degrees (3*12.5 degrees). In the above-described operation, a rotational angular range of the second date indicator 522 is 75 degrees (3*25 degrees)

(1-7) Operation of Hand Setting:

Next, an explanation will be given of operation when hand setting is carried out in the timepiece attached with the calendar mechanism of the invention. In reference to FIG. 2 through FIG. 5, in a state of drawing the hand setting stem 110 to second stage, when the hand setting stem 110 is rotated, based on rotation of the clutch wheel 175, the minute wheel 174 is rotated by way of rotation of the setting wheel 177. Therefore, "hand setting" can be carried out by rotating the hand setting stem 110 when the hand setting stem 110 is disposed at second stage. That is, by rotating the hand setting stem 110 when the hand setting stem 110 is disposed at second stage, by rotating the hour wheel 160 by way of the clutch wheel 175, the setting wheel 177, the minute wheel 174, an indicating content of "hour" indicated by the hour hand 166 attached to the hour wheel 160 can be corrected, simultaneously therewith, by rotating the minute indicator 152, an indicating content of "minute" indicated by the minute hand 154 attached to the minute indicator 152 can be corrected. When the hand setting stem 110 is disposed at second stage, during a time period of correcting the display contents of "hour" and "minute" by the operation of setting the fifth wheel & pinion 140 by the setting lever 170, the fifth wheel & pinion 140 and the second indicator 142 are not rotated and an indicating content of "second" remains unchanged.

(1.8) Operation of Date Correction:

Next, an explanation will be given of operation when date correction is carried out in the timepiece attached with the calendar mechanism of the invention. In reference to FIG. 3 and FIG. 5, in a state in which the hand setting stem 110 is disposed at first stage, a cooperative hole of the first intermediate date corrector setting wheel 591 is fitted with the second square portion 110F of the hand setting stem 110, and the first intermediate date corrector setting wheel 591 is rotated based on rotation of the hand setting stem 110. Under the state, when the hand setting stem 110 is rotated in the first direction, the fourth intermediate date corrector setting wheel 594 and the date corrector setting wheel 595 are rotated based on rotation of the first intermediate date corrector setting wheel 591 by way of the second intermediate date corrector setting wheel 592, the third intermediate date corrector setting wheel 593. Based on rotation of the third intermediate date corrector setting wheel 593, the date corrector setting wheel 595 is pivoted to the position of being brought in mesh with the first date indicator teeth portion 516 of the first date indicator 512 to stop and the date corrector setting wheel 595 is rotated at the corrected position. When the date corrector setting wheel 595 is rotated at the corrected position, the first date indicator 512 can be rotated in the counterclockwise direction. When the hand setting stem 110 is rotated in the first direction in the state of drawing the hand setting stem 110 to first stage, the date corrector setting wheel 595 is rotated and the date character indicated from the date window 105 by the first date indicator 512 can be changed. For example, as shown by FIG. 6, in a state in which the first date indicator 512 indicates "9" and the second date indicator 522 indicates "2", when the hand setting stem 110 is rotated in the first direction in the state of drawing the hand setting stem 110 to first stage, the date indicator driving wheel 595 is rotated, the date character indicated by the first date indicator 512 can be changed to "0", and the date character indicated by the second date indicator 522 can be changed to "3". When the hand setting stem 110 is disposed at first stage, even in a case of rotating the hand setting stem 110 in a direction reverse to the first direction, the date indicator driving wheel 595 is not pivoted at the corrected position and therefore, "date correction" cannot be carried out.

(2) Second Embodiment

Next, a second embodiment of the invention will be explained. In the following explanation, a description will mainly be given of a point of the second embodiment of the invention different from the first embodiment of the invention.

Therefore, the above-described explanation of the first embodiment of the invention will be applied to a portion which is not described below. The second embodiment of the invention is an embodiment of constituting an analog electronic timepiece arranged with a date window of the timepiece attached with the calendar mechanism at 3 o'clock position of the dial.

Figure 12:
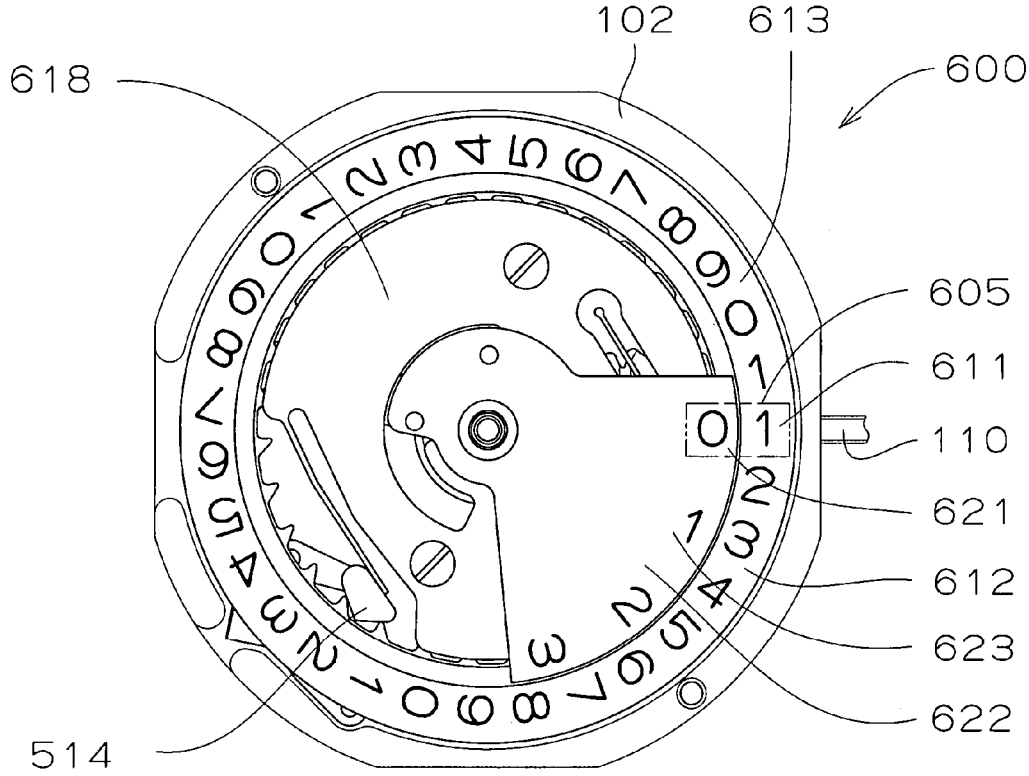
FIG. 12 is an outline plane view showing structures of a first date indicator and a second date indicator and the like in viewing a movement from a dial side in a constitution of arranging a date window in "3 o'clock direction" of a dial according to a second embodiment of the invention.
Figure 13:
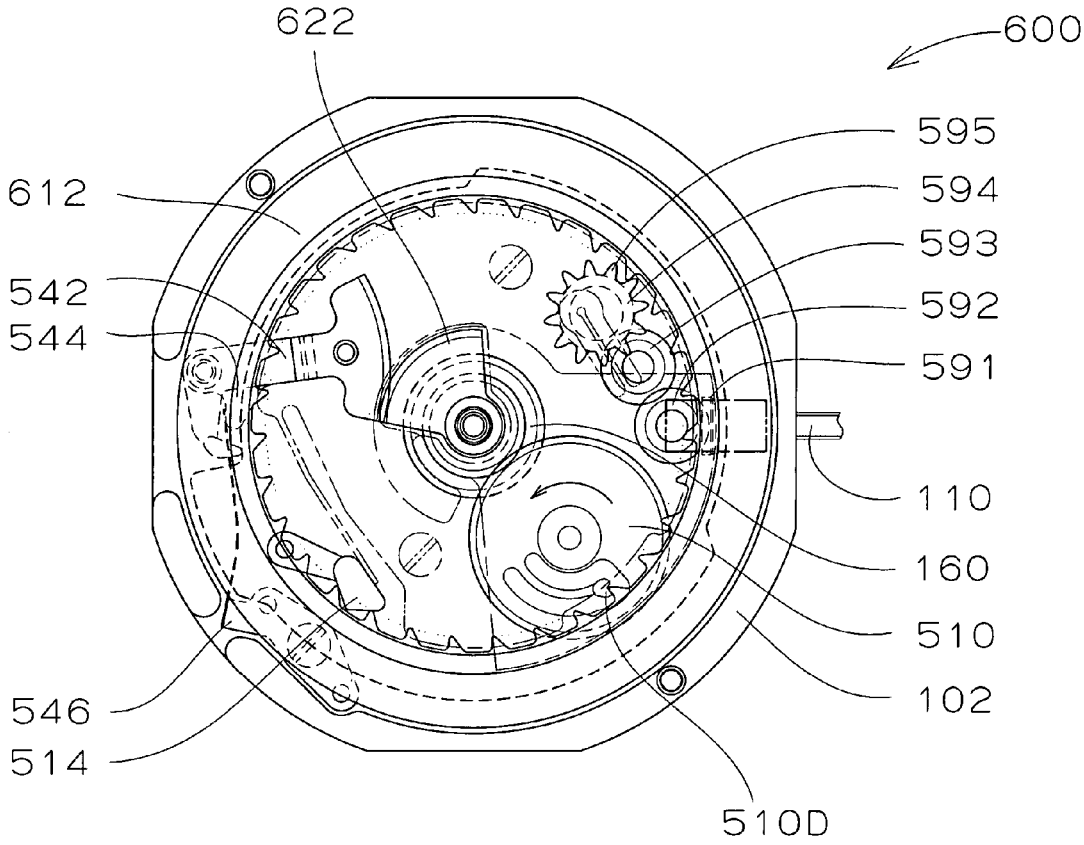
FIG. 13 is a plane view showing a calendar mechanism in viewing the movement from the dial side according to the second embodiment of the invention.

In reference to FIG. 12 and FIG. 13, in a case of a constitution formed with a date window 605 in "3 o'clock direction" of a dial 604, a movement 600 of the timepiece attached with the calendar mechanism includes a first date indicator 612, a second date indicator 622, a first date indicator holder 618. The first date indicator 612 includes a first date character indicating face 613 in a ring-like shape. The first date character indicating face 613 is provided with first date characters 611 comprising 31 pieces of numerals. The first date characters 611 include 31 pieces of numerals of "1", "1", "2", "3", "4", "5", "6", "7", "8", "9", "0", "1", "2", "3", "4", "5", "6", "7", "8", "9", "0", "1", "2", "3", "4", "5", "6", "7", "8", "9", "0". The respective first date characters 611 are arranged such that right sides of the characters are directed in "3 o'clock direction" of the movement 600 when arranged at the date window 605 of the dial 604. In a state shown in FIG. 12; "1" of "1" and "1" of the first date characters 611 arranged contiguously to each other proximate to "2" is arranged at the date window 605 of the dial 604.

The second date indicator 622 includes a second character indicating face 623 formed in a fan-like shape. It is not necessary to form a notched portion at the second date indicator 622. It is preferable to form the second date character indicating face 623 by an open angle of 45 degrees to 90 degrees. A second date indicator teeth portion of the second date indicator 622 can be formed by an open angle of 55 degrees through 100 degrees. It is preferable to form the wheel portion 542B of the drive cam lever 542 by an open angle of 15 degrees through 30 degrees. The second character indicating face 621 is arranged at a position more proximate to the dial 604 than the first date character indicating face 611. The second character indicating face 623 is provided with second date characters 621 comprising 4 pieces of numerals, that is, "0", "1", "2", "3". The respective second date characters 621 are arranged such that right sides of the characters are directed in "3 o'clock direction" of the movement 600 when arranged at inside of the date window 605 of the dial 604. The second date character indicating face 623 is arranged on an inner side of the first date character indicating face 613. In a state shown in FIG. 12, "0" of the second date character 621 is arranged at a left side portion of the date window 605 of the dial 604, and "1" of the first date character 611 is arranged at the date window 605 of the dial 604 on the right side of the second date indicator 622 to indicate "01 day" at inside of the date window 605.

Figure 14:
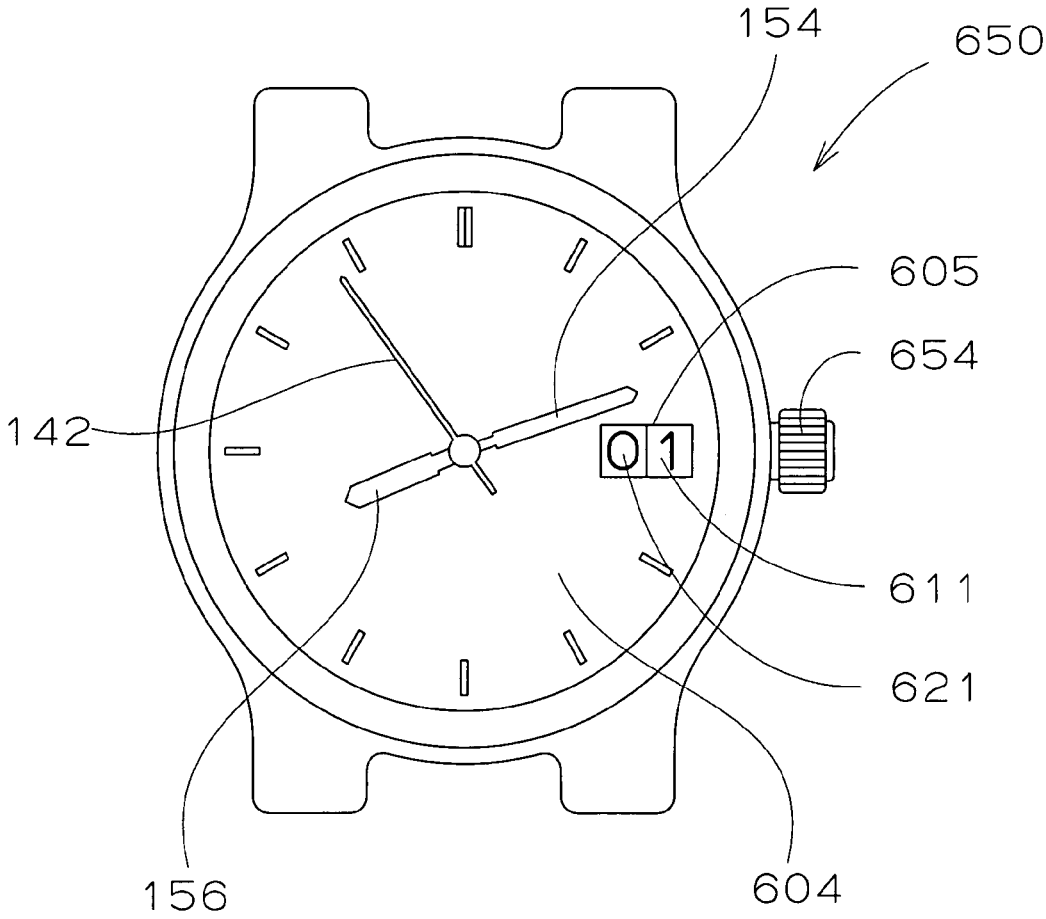
FIG. 14 is a plane view showing a complete in the constitution of arranging the date window in "3 o'clock direction" of the dial according to the second embodiment of the invention.

In reference to FIG. 14, in a complete 650, the date window 605 is formed in "3 o'clock direction" of the dial 604. The left side portion of the date window 605 of the dial 604 is arranged with "0" of the second date characters 621 of the second date indicator 622, and a right side portion of the date window 605 is arranged with "1" of the first date characters 611 of the first date indicator 612. Therefore, the complete 650 indicates "1 day". Time information is indicated by the second indicator 142, the minute hand 154, the hour hand 156. Operation of pushing and pulling the hand setting stem 110 and rotating operation thereof can be carried out by operating "crown 654".

(3) Third Embodiment

Next, a third embodiment of the invention will be explained. In the following explanation, a description will mainly be given of a point of the third embodiment of the invention different from the first embodiment of the invention. Therefore, the above-described explanation of the first embodiment of the invention will be applied to a portion which is not described below. The third embodiment of the invention is an embodiment constituted by an analog electronic timepiece arranged with a date window of the timepiece attached with the calendar mechanism in "6 o'clock direction" of a dial.

Figure 15:
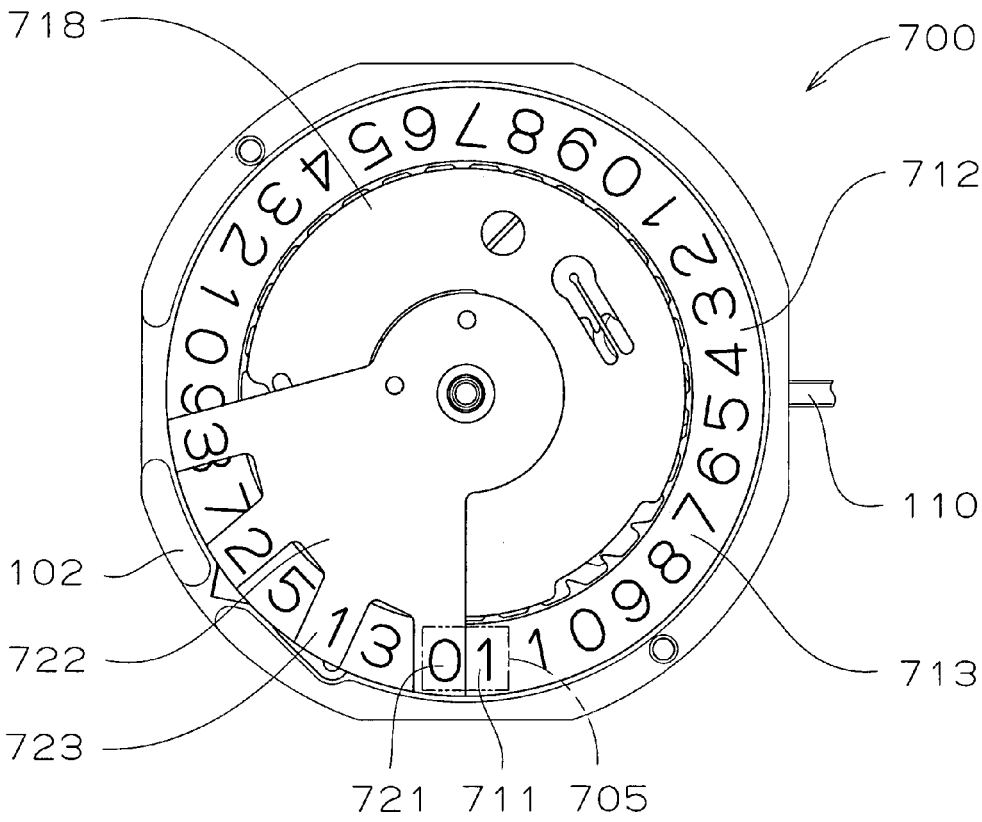
FIG. 15 is an outline plane view showing structures of a first date indicator and a second date indicator and the like in viewing a movement from a dial side in a constitution of arranging a date window in "6 o'clock direction" of a dial according to a third embodiment of the invention.

In reference to FIG. 15, in a case of a constitution of forming a date window 705 in "6 o'clock direction" of a dial 704, a movement 700 of the timepiece attached with the calendar mechanism includes a first date indicator 712, a second date indicator 722, a first date indicator holder 718. The first date indicator 712 includes a first date character indicating face 713 in a ring-like shape. The first date character indicating face 713 is provided with first date characters 711 comprising 31 pieces of numerals. The first date characters 711 include 31 pieces of numerals of "1", "1", "2", "3", "4", "5", "6", "7", "8", "9", "1", "2", "36", "4", "5", "6""7", "8", "9", "0", "1", "2", "3", "4", "5", "6", "7", "8""9", "0". The respective first date characters 711 are arranged such that lower sides of the characters are directed in "6 o'clock direction" of the movement 700, when arranged at inside of the date window 705 of the dial 704. In a state shown in FIG. 15, "1" of "1" and "1" of the first date characters 711 arranged contiguously to each other proximate to "2" is arranged at the date window 705 of the dial 704.

The second date indicator 722 includes a second date character indicating face 723 provided with 3 pieces of notched portions and formed in a fan-like shape. The second date character indicating face 723 is arranged at a position more proximate to the dial 704 than the first date character indicating face 713. The second date character indicating face 723 is provided with second date characters 721 comprising 4 pieces of numerals, that is, "0", "1", "2", "3". The respective second date characters 721 arranged such that lower sides of the characters are directed in "6 o'clock direction" of the movement 700 when arranged at inside of the date window 705 of the dial 704. In a state shown in FIG. 15, "0" of the second date characters 721 is arranged on a left side portion of the date window 705 of the dial 704, "1" of the first date character 711 is arranged at the date window 705 of the dial 704 on the right side of the second date indicator 722 to indicate "01 day" at inside of the date window 705.

As has been explained above, according to the movements of the first embodiment, the second embodiment, the third embodiment of the invention, parts excluding the first indicator, the second indicator can be designed and fabricated to use to avail in the similar way. Therefore, a timepiece attached with a calendar mechanism which can develop design variations can be provided. That is, according to the movement of the timepiece attached with the calendar mechanism of the invention, the structure of the date feed mechanism is concise, availability of parts is high, and fabrication and integration thereof are facilitated.

Figure 16:
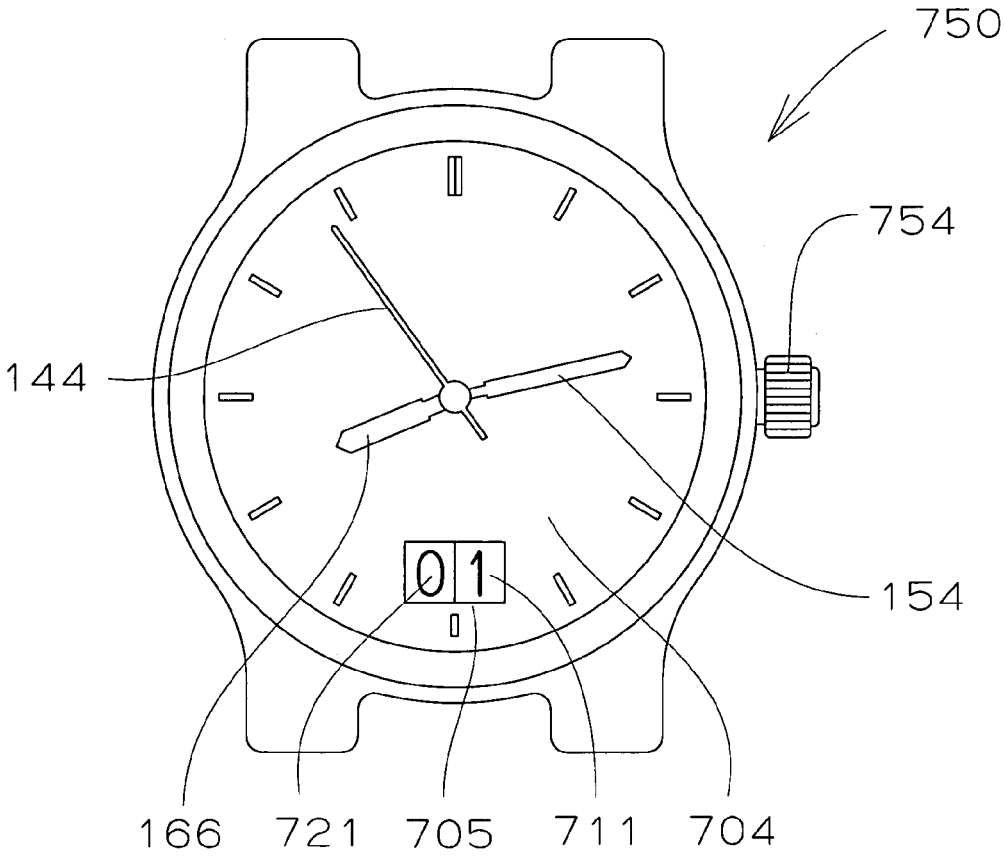
FIG. 16 is a plane view showing a complete in the constitution of arranging the date window in "6 o'clock direction" of the dial according to the third embodiment of the invention.

In reference to FIG. 16, in a complete 750, the date window 705 is formed in "6 o'clock direction" of the dial 704. In the complete 750, a left side portion of the date window 705 of the dial 704 is arranged with "0" of the second date character 721 of the second date indicator 722, and a right side portion of the date window 705 is arranged with "1" of the first date characters 711. Therefore, the complete 750 indicates "1 day". Time information is indicated by the secondhand 144, the minute hand 154, the hour hand 156. Operation of pushing and pulling the hand setting stem 110 and rotating operation thereof can be carried out by operating "crown 754".

(4) Fourth Embodiment

Next, a fourth embodiment of the invention will be explained. In the following explanation, a description will mainly be given of a point of the fourth embodiment of the invention different from the first embodiment of the invention. Therefore, the above-described explanation of the first embodiment of the invention will be applied to a portion which is not described below. The fourth embodiment of the invention is an analog electronic timepiece attached with a calendar mechanism and attached with a small second hand.

Figure 17:
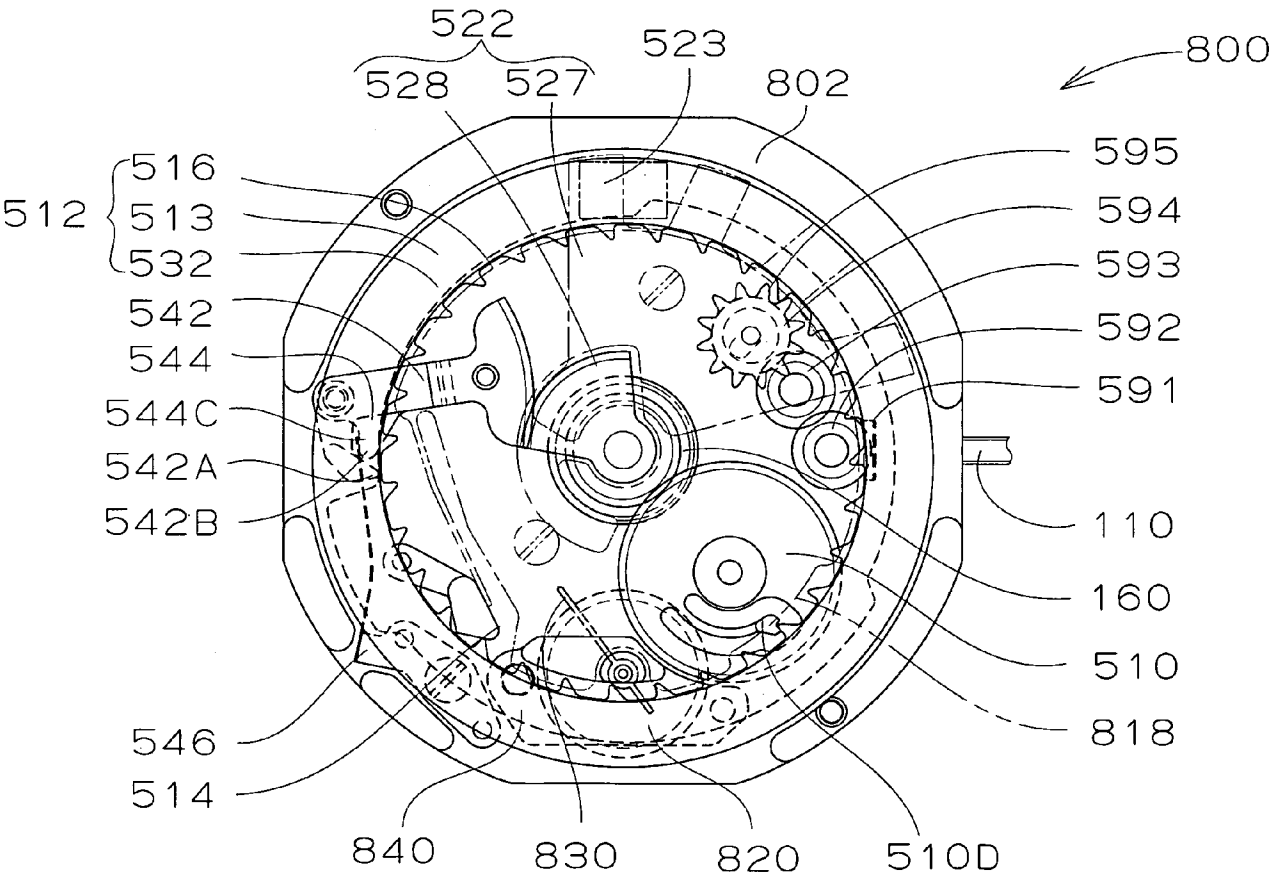
FIG. 17 is a plane view showing a calendar mechanism, a second indicating mechanism and the like in viewing a movement from a dial side according to a fourth embodiment of the invention.

In reference to FIG. 17, a movement 800 of the timepiece attached with the calendar mechanism includes a main plate 802. A second indicating mechanism is constituted to be operated based on rotation of the fifth wheel & pinion 140. The fifth wheel & pinion 140 includes a fifth wheel, a fifth pinion, and a fifth lower pinion. The second indicating mechanism includes a second indicator 820. A wheel portion (not illustrated) of the second indicator 820 is constituted to be brought in mesh with the fifth lower pinion. The second indicator 820 is constituted to rotate by rotation of the rotor 134 by way of rotation of the fifth wheel & pinion 140. A lower shaft portion of the second indicator 820 is rotatably supported by the main plate 802. An upper shaft portion of the second indicator 820 is rotatably supported by a second indicator bridge 840. The upper shaft portion of and a rotational center of the second indicator 820 is arranged on an outer side of a region of moving the second date character indicating face 523 of the second date indicator 522 and on an inner side of the first date character indicating face 513 of the first date indicator 512. According to the constitution, it is preferable to form the second date character indicating face 523 by an open angle equal to or smaller than 90 degrees.

It is preferable to arrange a rotational center of the second indicator 820 in "6 o'clock direction". The second indicator 820 is constituted to rotate once per minute. A small second hand 830 is attached to a front end portion of the upper shaft portion of the second indicator 820. Characters, numerals, abbreviated characters or the like for indicating "second" are provided at the dial 104. There is constructed a constitution capable of indicating information with regard to "second" constituting time information by the small second hand 830 and the numerals or the like. According to the constitution, it is not necessary to attach the second hand 144 to the second indicator 142. Although an explanation has been given of the constitution of the analog electronic timepiece attached with the calendar mechanism and attached with the small second hand according to the fourth embodiment of the invention, the invention can be constituted to indicate information with regard to time, calendar of "day indication", "hour indication by 24 hours system", "chronograph indication" or the like by a small indicating hand by changing a constitution of a main plate, a bridge member, a portion of a back train wheel. For example, "time indication by 24 hour system" can be carried out by providing a 24 hours indicator rotated by one rotation per 24 hours by rotating the hour wheel and attaching a 24 hours hand to the 24 hours indicator. For example, "chronograph indication" can be carried out by providing a publicly-known chronograph train wheel and attaching a chronograph indicating hand to the chronograph train wheel. In such a constitution, it is preferable to provide a train wheel mechanism for indicating information with regard to hour, calendar by a small indicating hand, and arranging a rotational center of an indicator rotated for indicating the information based on rotation of a top train wheel on an outer side of a region of moving a second date character indicating face and on an inner side of a first date character indicating face.

(5) Case of Constituting the Invention by Mechanical Type Timepiece

In a case of constituting the invention by a mechanical type timepiece, structure and operation of a switching mechanism, a calendar feed mechanism, a calendar correcting mechanism are similar to structure and operation of the above-described embodiments of the invention. Although details of the structure are not illustrated, according to a mechanical type timepiece, a fourth wheel & pinion is rotated by one rotation per minute by rotating a barrel complete wheel of a barrel complete by way of rotation of a second wheel & pinion, a third wheel & pinion. A rotational speed of the fourth wheel & pinion is controlled by an escape wheel & pinion. A rotational speed of the escape wheel & pinion is controlled by a pallet fork. A pivoting movement of the pallet fork is controlled by a balance with hairspring. A minute indicator is rotated by one rotation per hour by rotation of the third wheel & pinion. An hour wheel is constituted to rotate by one rotation per 12 hours by rotation of the minute wheel by way of rotation of the hour wheel. The date indicator driving wheel 510 is rotated by rotating the hour wheel and a date indicator driving finger 510D rotates the first date indicator 512 by an amount of one tooth by once per day. Date can be indicated from the date window of the dial by the second date character 523 of the second date indicator 522 and the first date character 513 of the first date indicator 512 by operating the date feeding.

The timepiece attached with the calendar mechanism of the invention includes the first date indicator for indicating the position of 1 of the date and the second date indicator for indicating the position of 10 of the date and can carry out large date indication. Further, according to the timepiece attached with the calendar mechanism of the invention, the rotational center of the first date indicator and the rotational center of the second date indicator can be arranged at the same position and therefore, a degree of freedom is provided in the date indicating position and a design variation can be developed. Further, according to the timepiece attached with the calendar mechanism of the invention, a structure of the date feeding mechanism is concise, availability of part is high and fabrication and integration thereof are facilitated.

According to the invention, there can be provided a timepiece attached with the calendar mechanism capable of large date indication, having a degree of freedom of a date indicating position, and capable of developing a design variation. According to the timepiece attached with the calendar mechanism of the invention, the structure of the date feeding mechanism is concise and fabrication thereof is facilitated.

What is claimed is:

1. A timepiece attached with a calendar mechanism including two date indicators, comprising:

a first date indicator for indicating a units position of a date; and a second date indicator for indicating a tens position of the date;

wherein the first date indicator comprises a first date indicator wheel portion for rotating the first date indicator by rotation of a top train wheel and a drive cam for rotating the second date indicator and determining a position of the second date indicator;

wherein the first date indicator includes a first character indicating face having 31 pieces of numerals of "1", "1", "2", "3", "4", "5", "6", "7", "8", "9", "0", "1", "2", "3", "4", "5", "6", "7", "8", "9", "0", "1", "2", "3", "4", "5", "6", "7", "8", "9", and "0"; and wherein the second date indicator includes a first date character indicating face having numerals "1", "2", "3", and "0", and a second date character indicating face having a fan-like shape and including four pieces of trapezoidal-shaped portions formed by a pitch interval of (2*360/31) degrees through (3*360/31) degrees, three pieces of notched portions formed by a pitch interval of (2*360/31) degrees through (3*360/31) degrees, and a set of numerals comprising a numeral of "1", a numeral of "2", a numeral of "3", and a numeral of "0".

2. A timepiece attached with a calendar mechanism according to claim 1; wherein a rotational center of the first date indicator and a rotational center of the second date indicator are arranged at the same position, and the second date character indicating face of the second date indicator is formed by an open angle equal to or smaller than 90 degrees.

3. The A timepiece attached with a calendar mechanism according to claim 1; wherein the drive cam of the first date indicator includes a plurality of cam circular arc portions defined by circular arcs having a different radius from one another, and the second date indicator is mounted for undergoing movement within a moving range in a fan-like shape.

4. A timepiece attached with a calendar mechanism according to claim 1; further comprising:

a drive cam lever including a portion that is brought into contact with the drive cam of the first date indicator and a wheel portion that is brought into meshing engagement with a wheel portion of the second date indicator;

a rotation control lever having a wheel portion that is brought into meshing engagement with the wheel portion of the second date indicator; and a rotation control lever spring that exerts an elastic force to the rotation control lever for restricting rotation of the second date indicator.

5. A timepiece attached with a calendar mechanism according to claim 1; wherein the second date character indicating face of the second date indicator has a fan-like shape and is provided with a set of numerals comprising a numeral of "1", a numeral of "2 ", a numeral of "3", and a numeral of "0", the second date character indicating face being arranged on a inner side of the first date character indicating face.

6. A timepiece attached with a calendar mechanism according to claim 1; further comprising an indicating mechanism including a time indicator mounted for undergoing rotation in accordance with rotation of the top train wheel to indicate time information in seconds, a rotational center of the time indicator being arranged on an outer side of a movement region of the second date character indicating face and on an inner side of the first date character indicating face of the second date indicator.

7. A timepiece attached with a calendar mechanism according to claim 1; further comprising a train wheel mechanism including an indicator mounted for undergoing rotation in accordance with rotation of the top train wheel to indicate time information, a rotational center of the indicator being arranged on an outer side of a movement region of the second date character indicating face and on an inner side of the first date character indicating face.

8. A timepiece with a calendar mechanism comprising:

a train wheel mounted to undergo rotation;

a first date indicator that indicates a units position of a date, the first date indicator having a date indicator wheel portion that undergoes rotation in accordance with rotation of the train wheel;

a second date indicator that indicates a tens position of the date; and a drive cam that rotates the second date indicator and determines a position of the second date indicator, the drive cam including a plurality of cam circular arc portions defined by circular arcs each having a different radius from one another.

9. A timepiece with a calendar mechanism according to claim 8; wherein the second date indicator is mounted to undergo movement within a moving range in a fan-like shape.

10. A timepiece with a calendar mechanism according to claim 8; wherein the drive cam forms part of the first date indicator.

11. A timepiece with a calendar mechanism according to claim 8; wherein the first date indicator includes a first character indicating face having 31 pieces of numerals of "1", "1", "2", "3", "4", "5", "6", "7", "8", "9", "0", "1", "2", "3", "4", "5", "6", "7","8", "9", "0", "1", "2","3", "4", "5", "6", "7", "8", "9", and "0"; and wherein the second date indicator has a first date character indicating face including numerals, "1", "2", "3", and "0", and a second date character indicating face having a fan-like shape and including four pieces of trapezoidal-shaped portions formed by a pitch interval of (2*360/31) degrees through (3*360/31) degrees, three pieces of notched portions formed by a pitch interval of (2*360/31) degrees through (3*360/31) degrees, and a set of numerals comprising a numeral of "1", a numeral of "2 ", a numeral of "3", and a numeral of "0"

12. A timepiece attached with a calendar mechanism according to claim 11; wherein the second date character indicating face of the second date indicator has a fan-like shape and is provided with a set of numerals comprising a numeral of "1", a numeral of "2", a numeral of "3", and a numeral of "0", the second date character indicating face being arranged on a inner side of the first date character indicating face.

13. A timepiece attached with a calendar mechanism according to claim 11; further comprising an indicating mechanism including a time indicator mounted for undergoing rotation in accordance with rotation of the train wheel to indicate time information in seconds, a rotational center of the time indicator being arranged on an outer side of a movement region of the second date character indicating face and on an inner side of the first date character indicating face of the second date indicator.

14. A timepiece attached with a calendar mechanism according to claim 11; further comprising a train wheel mechanism including an indicator mounted for undergoing rotation in accordance with rotation of the train wheel to indicate time information, a rotational center of the indicator being arranged on an outer side of a movement region of the second date character indicating face and on an inner side of the first date character indicating face.

15. A timepiece attached with a calendar mechanism according to claim 8; wherein a rotational center of the first date indicator and a rotational center of the second date indicator are arranged at the same position, and the second date character indicating face of the second date indicator is formed by an open angle equal to or smaller than 90 degrees.

16. A calendar mechanism comprising:

a first date indicator that indicates a units position of a date; and a second date indicator that indicates a tens position of the date;

wherein the first date indicator has a drive cam that rotates the second date indicator and determines a position of the second date indicator, the drive cam having a plurality of cam circular arc portions defined by circular arcs each having a different radius from one another.

17. A calendar mechanism according to claim 16; wherein the second date indicator is mounted to undergo movement within a moving range in a fan-like shape.

18. A calendar mechanism according to claim 16; wherein the first date indicator includes a first character indicating face having 31 pieces of numerals of "1", "1", "2", "3", "4", "5", "6", "7", "8", "9", "0", "1", "2", "3", "4", "5", "6", "7", "8", "9", "0", "1", "2", "3", "4", "5", "6", "7", "8", "9", and "0"; and wherein the second date indicator has a first date character indicating face including numerals "1", "2", "3", and "0", and a second date character indicating face having a fan-like shape and including four pieces of trapezoidal-shaped portions formed by a pitch interval of (2*360/31) degrees through (3*360/31) degrees, three pieces of notched portions formed by a pitch interval of (2*360/31) degrees through (3*360/31) degrees, and a set of numerals comprising a numeral of "1", a numeral of "2", a numeral of "3", and a numeral of "0".

19. A calendar mechanism according to claim 18; wherein the second date character indicating face of the second date indicator has a fan-like shape and is provided with a set of numerals comprising a numeral of "1", a numeral of "2", a numeral of "3", and a numeral of "0", the second date character indicating face being arranged on a inner side of the first date character indicating face.

20. A calendar mechanism according to claim 16; wherein a rotational center of the first date indicator and a rotational center of the second date indicator are arranged at the same position, and the second date character indicating face of the second date indicator is formed by an open angle equal to or smaller than 90 degrees.

* * * * *